US009418641B2

(12) United States Patent
Stone

(10) Patent No.: US 9,418,641 B2
(45) Date of Patent: Aug. 16, 2016

(54) SWAP DIVISI PROCESS

(71) Applicant: Audio Impressions, Oak Park, CA (US)

(72) Inventor: Christopher L. Stone, Oak Park, CA (US)

(73) Assignee: AUDIO IMPRESSIONS, Oak Park, CA (US)

( * ) Notice: Subject to any disclaimer, the term of this patent is extended or adjusted under 35 U.S.C. 154(b) by 3 days.

(21) Appl. No.: 14/444,954

(22) Filed: Jul. 28, 2014

(65) Prior Publication Data

US 2015/0027299 A1 Jan. 29, 2015

Related U.S. Application Data

(60) Provisional application No. 61/858,836, filed on Jul. 26, 2013.

(51) Int. Cl.

| | |
|---|---|
| ***A63H 5/00*** | (2006.01) |
| ***G04B 13/00*** | (2006.01) |
| ***G10H 7/00*** | (2006.01) |
| ***G10H 1/00*** | (2006.01) |
| ***G10H 1/22*** | (2006.01) |
| ***G10H 1/46*** | (2006.01) |

(52) U.S. Cl.

CPC ..... *G10H 1/0066* (2013.01); *G10H 1/22* (2013.01); *G10H 1/46* (2013.01)

(58) Field of Classification Search

CPC ..... G10H 1/183; G10H 1/0066; G10H 1/22; G10H 1/46

USPC ..... 84/609

See application file for complete search history.

(56) References Cited

U.S. PATENT DOCUMENTS

| | | | | |
|---|---|---|---|---|
| 4,703,681 | A | 11/1987 | Okamoto | |
| 4,711,148 | A * | 12/1987 | Takeda et al. | 84/653 |
| 4,926,736 | A * | 5/1990 | Kozuki | 84/609 |
| 4,984,497 | A | 1/1991 | Inagaki et al. | |
| 5,025,701 | A * | 6/1991 | Matsumoto | 84/615 |

(Continued)

FOREIGN PATENT DOCUMENTS

| | | |
|---|---|---|
| EP | 0743631 A2 | 11/1996 |
| EP | 1617406 A1 | 1/2006 |

(Continued)

OTHER PUBLICATIONS

"Garritan Personal Orchestra Ensemble Building," Garritan Orchestral Libraries, http://web.archive.org/web/20041011021446/garritan.com/GPO-ensemble.html, Oct. 11, 2004.

(Continued)

*Primary Examiner* — Jeffrey Donels

(74) *Attorney, Agent, or Firm* — Nixon Peabody LLP; Joseph Bach, Esq.

(57) ABSTRACT

A divisi process in which different samplings are provided of full section, half a section, quarter section, etc. When a first note on input is received, the note is assigned to the full section. When a subsequent note on input is received, it is assigned to a half section. At that time, the volume of the full section may be reduced. Upon receiving further note on inputs, the notes may be assigned to another half section or to a quarter section depending on the number of notes being played simultaneously. The volume of notes being played is adjusted when a new note is added.

20 Claims, 19 Drawing Sheets

(56) References Cited

U.S. PATENT DOCUMENTS

| | | | | |
|---|---|---|---|---|
| 5,095,800 | A | 3/1992 | Matsuda | |
| 5,369,224 | A | 11/1994 | Miyata | |
| 5,410,099 | A * | 4/1995 | Kosugi | 84/618 |
| 5,703,312 | A | 12/1997 | Takahashi et al. | |
| 5,850,051 | A | 12/1998 | Machover et al. | |
| 5,895,877 | A | 4/1999 | Tamura | |
| 5,959,232 | A | 9/1999 | Wakuda | |
| 5,998,724 | A | 12/1999 | Takeuchi et al. | |
| 6,369,311 | B1 | 4/2002 | Iwamoto | |
| 6,582,235 | B1 | 6/2003 | Tsai et al. | |
| 6,639,141 | B2 | 10/2003 | Kay | |
| 6,703,549 | B1 | 3/2004 | Nishimoto et al. | |
| 6,960,715 | B2 | 11/2005 | Riopelle | |
| 7,005,572 | B2 | 2/2006 | Fay | |
| 7,109,406 | B2 * | 9/2006 | Stone et al. | 84/609 |
| 7,169,997 | B2 | 1/2007 | Kay | |
| 7,465,865 | B2 * | 12/2008 | Terao | 84/600 |
| 7,728,213 | B2 | 6/2010 | Stone et al. | |
| 2004/0099125 | A1 | 5/2004 | Kay | |
| 2004/0159219 | A1 | 8/2004 | Holm et al. | |
| 2004/0267541 | A1 | 12/2004 | Hamalainen et al. | |
| 2005/0056143 | A1 | 3/2005 | Fay | |
| 2005/0076770 | A1 | 4/2005 | Stone et al. | |
| 2005/0257669 | A1 * | 11/2005 | Frangopol et al. | 84/615 |
| 2006/0236848 | A1 * | 10/2006 | Stone et al. | 84/615 |

FOREIGN PATENT DOCUMENTS

| | | | |
|---|---|---|---|
| EP | 2015855 | A1 | 1/2009 |
| EP | 2122606 | B1 | 10/2013 |
| WO | 2007/123549 | A1 | 11/2007 |
| WO | 2007/130056 | A1 | 11/2007 |
| WO | 2008/008418 | A2 | 1/2008 |
| WO | 2008/016649 | A2 | 2/2008 |
| WO | 2008/094415 | A2 | 8/2008 |

OTHER PUBLICATIONS

"Garritan Personal Orchestra Ensemble Controls," Garritan Orchestral Libraries, http://web.archive.org/web/20041011020846/garritan.com/GPO-control.html, Oct. 11, 2004.

"Garritan Orchestra FAQ Page," Garritan Orchestral Libraries, http://www.garritan.com/FAQ.html, Oct. 11, 2004.

"Garritan Personal Orchestra Features," Garritan Orchestral Libraries, http://web.archive.org/web/20041009173443/garritan.com/GPO.html, Oct. 11, 2004.

Restriction Requirement for U.S. Appl. No. 10/684,296 dated Oct. 5, 2005.

Office Action for U.S. Appl. No. 10/684,296 dated Dec. 29, 2005.

Office Action for U.S. Appl. No. 10/684,296 dated Feb. 24, 2006.

Notice of Allowance for U.S. Appl. No. 10/684,296 dated May 9, 2006.

International Search Report for PCT/US2006/015853 dated Jan. 16, 2007.

International Search Report for PCT/US2006/017757 dated Oct. 12, 2006.

International Search Report for PCT/US2007/015860 dated Feb. 8, 2008.

International Search Report and Written Opinion for PCT/US2007/017192 dated Sep. 11, 2008.

International Search Report for PCT/US2008/000718 dated May 28, 2009.

International Preliminary Report on Patentability for PCT/US2006/015853 dated Nov. 6, 2008.

International Preliminary Report on Patentability for PCT/US2006/017757 dated Nov. 20, 2008.

International Preliminary Report on Patentability for PCT/US2007/015860 dated Jan. 22, 2009.

International Preliminary Report on Patentability for PCT/US2007/017192 dated Feb. 12, 2009.

International Preliminary Report on Patentability for PCT/US2008/000718 dated Nov. 26, 2009.

Restriction Requirement for U.S. Appl. No. 11/411,589 dated Jan. 15, 2008.

Office Action for U.S. Appl. No. 11/411,589 dated Apr. 17, 2008.

Office Action for U.S. Appl. No. 11/411,589 dated Dec. 10, 2008.

Notice of Allowance for U.S. Appl. No. 11/411,589 dated Jan. 29, 2010.

Office Action for European Patent Application No. 08724644.3 dated Mar. 1, 2013.

Office Action for European Patent Application No. 08724644.3 dated Oct. 30, 2012.

Extended Search Report for European Patent Application No. 08724644.3 dated Jul. 13, 2012.

Office Action for European Patent Application No. 06752409.0 dated Nov. 17, 2015.

Office Action for European Patent Application No. 06752409.0 dated Feb. 19, 2013.

Extended Search Report for European Patent Application No. 06752409.0 dated Sep. 24, 2012.

* cited by examiner

Figure 3a

300

Sample "Range Entry" for 7-way Swap Divisi – Full Strings Section

| | | |
|---|---|---|
| Full Section Range: | Lowest Note: | C0 (24) |
| | Highest Note: | F6 (101) |
| A Section Range: | Lowest Note: | C2 (48) |
| | Highest Note: | F6 (101) |
| B Section Range: | Lowest Note: | C0 (24) |
| | Highest Note: | G4 (79) |
| A1 Section Range: | Lowest Note: | C2 (48) |
| | Highest Note: | G5 (91) |
| A2 Section Range: | Lowest Note: | G2 (55) |
| | Highest Note: | F6 (101) |
| B1 Section Range: | Lowest Note: | C1 (36) |
| | Highest Note: | G4 (79) |
| B2 Section Range: | Lowest Note: | C0 (24) |
| | Highest Note: | G3 (67) |

301

Sample "Number of Swap Groups" Selection(choose 1):

2-Way Swap Mode
3-Way Swap Mode
5-Way Swap Mode
7-Way Swap Mode

Figure 3b

| Example of volume settings used when a note is added, or when a note is released and the full section group is still playing: | | | |
|---|---|---|---|
| **Number of Voices Playing** | **Full Section Volume** | **1/2 Section Volumes** | **1/4 Section Volumes** |
| 1 | 0.0 dB | 0.0 dB | 0.0 dB |
| 2 | -3.0 dB | 0.0 dB | 0.0 dB |
| 3 | -6.0 dB | 0.0 dB | 0.0 dB |
| 4 | -9.0dB | 0.0 dB | 0.0 dB |
| 5 | -12.0dB | 0.0 dB | 0.0 dB |
| 6 or more | -15.0dB | 0.0 dB | 0.0 dB |

| Example of volume settings used when a note is released, and the full section group is not playing, but at least one 1/2 section group is playing: | | | |
|---|---|---|---|
| **Number of Voices Playing** | **Full Section Volume** | **1/2 Section Volumes** | **1/4 Section Volumes** |
| 1 | N/A (Not playing) | +1.50 dB | 0.0 dB |
| 2 | N/A (Not playing) | +0.75 dB | 0.0 dB |
| 3 | N/A (Not playing) | +0.35 dB | 0.0 dB |
| 4 | N/A (Not playing) | +0.17 dB | 0.0 dB |
| 5 | N/A (Not playing) | +0.08 dB | 0.0 dB |
| 6 or more | N/A (Not playing) | +0.04 dB | 0.0 dB |

| Example of volume settings used when a note is released, and the full section group and 1/2 section groups are not playing, but at least one 1/4 section group is playing: | | | |
|---|---|---|---|
| **Number of Voices Playing** | **Full Section Volume** | **1/2 Section Volumes** | **1/4 Section Volumes** |
| 1 | N/A (Not playing) | N/A (Not playing) | +3.0 dB |
| 2 | N/A (Not playing) | N/A (Not playing) | +1.5 dB |
| 3 | N/A (Not playing) | N/A (Not playing) | +1.25 dB |
| 4 | N/A (Not playing) | N/A (Not playing) | +1.0 dB |
| 5 | N/A (Not playing) | N/A (Not playing) | +0.8 dB |
| 6 or more | N/A (Not playing) | N/A (Not playing) | +0.6 dB |

401

Held Note Table

| | | |
|---|---|---|
| 402 | Full Section | Allocated to Note # 60 (C3) |
| 403 | ½ Section A | Allocated to Note # 72 (C4) |
| 404 | ½ Section B | Not Allocated |
| 405 | 1/4 Section A1 | Allocated to Note # 84 (C5) |
| 406 | 1/4 Section A2 | Allocated to Note # 96 (C6) |
| 407 | 1/4 Section B1 | Not Allocated |
| 408 | 1/4 Section B2 | Not Allocated |

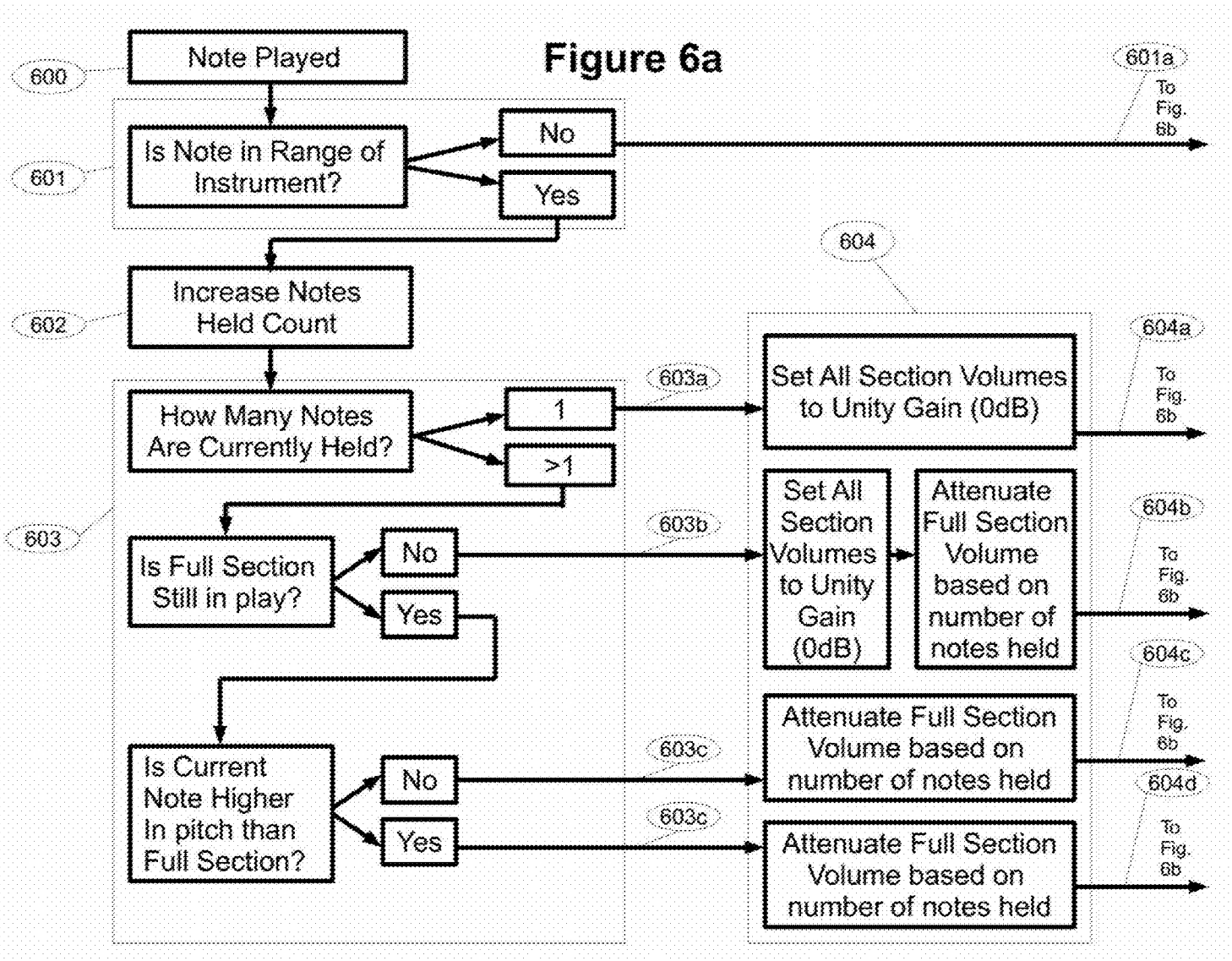
Figure 6a
Note Played
600
Is Note in Range of Instrument?
601
No
Yes
601a
To Fig. 6b
Increase Notes Held Count
602
How Many Notes Are Currently Held?
603
1
>1
603a
Is Full Section Still in play?
No
Yes
603b
Is Current Note Higher In pitch than Full Section?
No
Yes
603c
603c
604
Set All Section Volumes to Unity Gain (0dB)
Set All Section Volumes to Unity Gain (0dB)
Attenuate Full Section Volume based on number of notes held
Attenuate Full Section Volume based on number of notes held
Attenuate Full Section Volume based on number of notes held
604a
604b
604c
604d
To Fig. 6b
To Fig. 6b
To Fig. 6b
To Fig. 6b

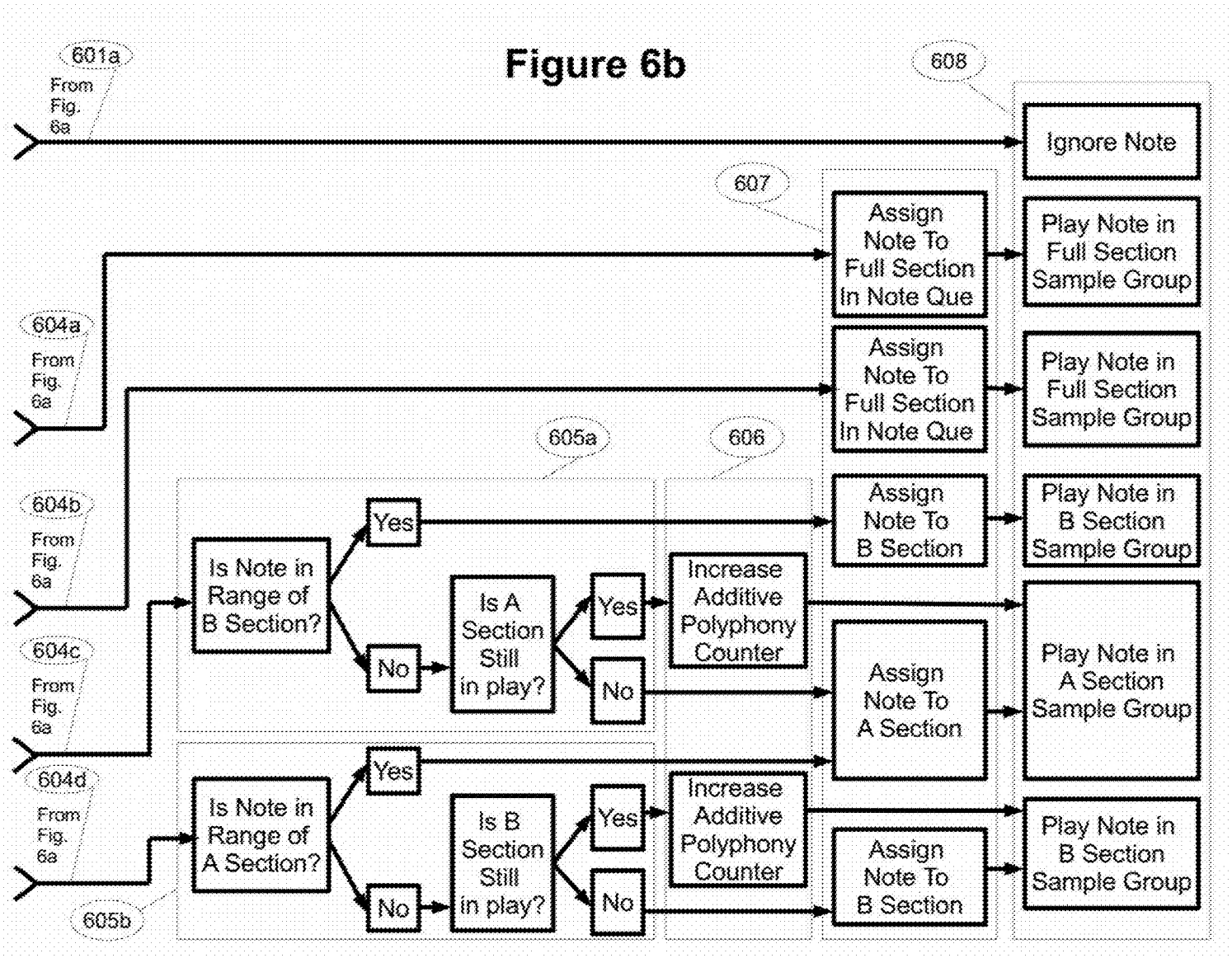
Figure 6b
601a
From Fig. 6a
604a
From Fig. 6a
604b
From Fig. 6a
604c
From Fig. 6a
604d
From Fig. 6a
605b
605a
606
607
608
Ignore Note
Play Note in Full Section Sample Group
Play Note in Full Section Sample Group
Play Note in B Section Sample Group
Play Note in A Section Sample Group
Play Note in B Section Sample Group
Assign Note To Full Section In Note Que
Assign Note To Full Section In Note Que
Assign Note To B Section
Assign Note To A Section
Assign Note To B Section
Increase Additive Polyphony Counter
Increase Additive Polyphony Counter
Yes
No
Yes
No
Is A Section Still in play?
Is B Section Still in play?
Yes
No
Yes
No
Is Note in Range of B Section?
Is Note in Range of A Section?

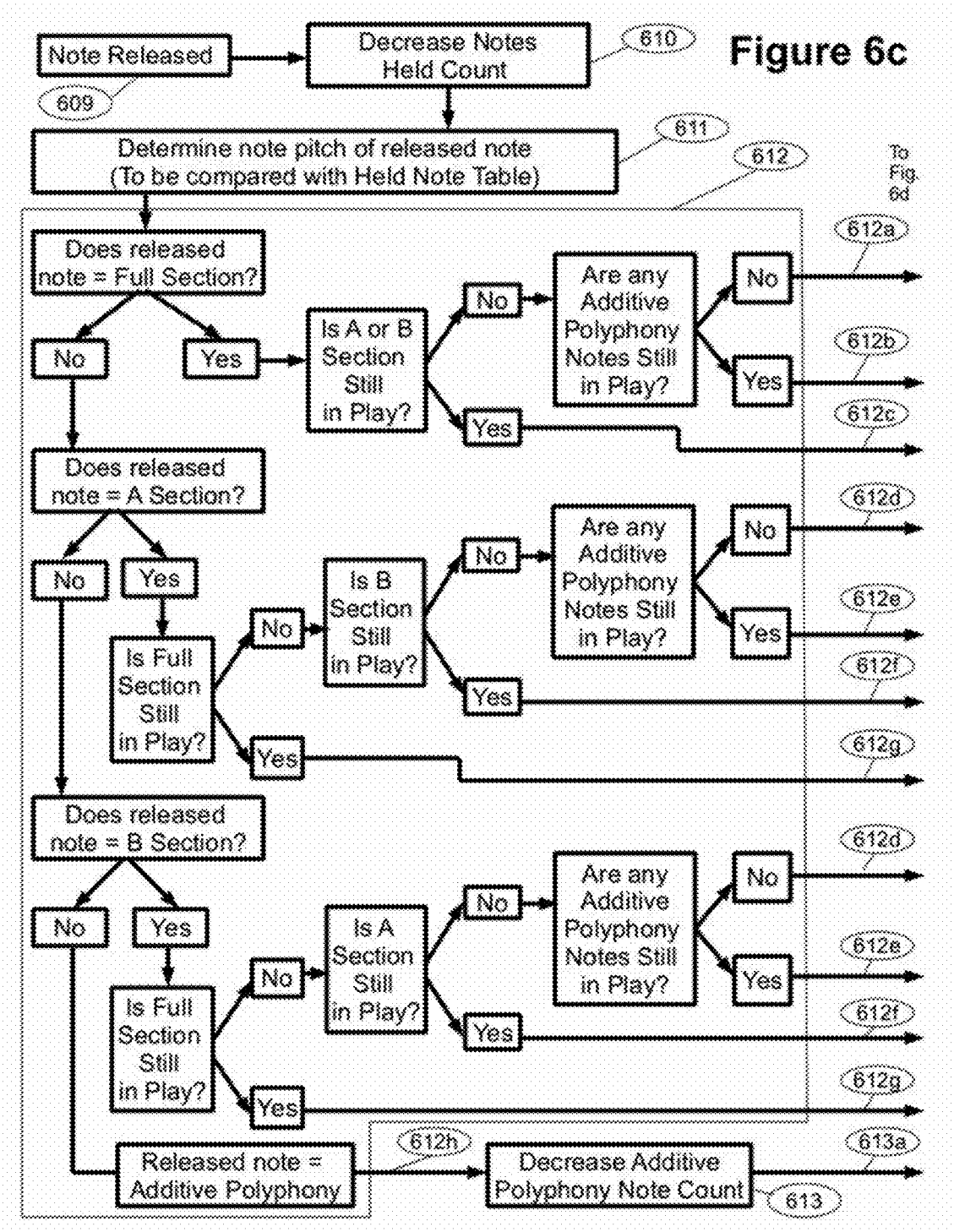
Note Released
609
Decrease Notes Held Count
610
Figure 6c
Determine note pitch of released note (To be compared with Held Note Table)
611
612
To Fig. 6d
Does released note = Full Section?
No
Yes
Is A or B Section Still in Play?
No
Yes
Are any Additive Polyphony Notes Still in Play?
No
Yes
612a
612b
612c
Does released note = A Section?
No
Yes
Is Full Section Still in Play?
No
Yes
Is B Section Still in Play?
No
Yes
Are any Additive Polyphony Notes Still in Play?
No
Yes
612d
612e
612f
612g
Does released note = B Section?
No
Yes
Is Full Section Still in Play?
No
Yes
Is A Section Still in Play?
No
Yes
Are any Additive Polyphony Notes Still in Play?
No
Yes
612d
612e
612f
612g
Released note = Additive Polyphony
612h
Decrease Additive Polyphony Note Count
613
613a

SWAP DIVISI PROCESS

RELATED APPLICATIONS

This application claims priority benefit from U.S. Provisional Application Ser. No. 61/858,836, filed on Jul. 26, 2013; this Application also relates to and is in the same technical field of U.S. Pat. Nos. 7,109,406 and 7,728,213, the disclosure of all of which is incorporated herein by reference in its entirety.

BACKGROUND

1. Technical Field

This disclosure relates to music technology and, more specifically, for technologies used to recreate sounds of various musical instruments, such as synthesizers and samplers.

2. Related Arts

The present author's two US patents for Divisi processes (U.S. Pat. Nos. 7,109,406 and 7,728,213) explain how to create divisi very much like that used by live musicians, but in an automated fashion suitable for sampled or synthesized sounds. The previously patented divisi processes generally incorporates a high voice count. In digital music production, "voice count" refers to the number of simultaneously playing recordings or discretely-generated sounds. As more notes are held on a keyboard or other note-designating system, and as notes continue to be sustained even after a key is released, the cumulative voice count increases. While the original implementations of the author's divisi processes were devised using digitally sampled music libraries, the processes were conceived equally to work with other types of synthesized sounds, and so while the specification uses examples based on sampled sounds these are intended to be exemplary and not limiting.

On a computer or digital note player, an increase in voice count will always increase the amount of CPU usage, and will also increase the amount of bandwidth used by the note player's memory, hard disk, or other data storage medium from which it streams the sampled recordings. Since the author's previously patented Divisi processes were designed to maintain the same number of recorded voices playing back consistently, regardless of the number of notes, they will always have a high voice count, regardless of the number of subsections into which the orchestra, band or other sampled entity is divided while playing. Although the author's earlier approach to Divisi represents a highly accurate method of reproducing a live ensemble, in some situations, such as when an entire section is playing in unison (all instruments playing the same note) this results an excessive amount of CPU usage. In turn, this limits the implementation of those earlier methods to use with more powerful, costly hardware systems, placing this technology out of reach for some potential users.

SUMMARY

The following summary of the invention is included in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

Various disclosed embodiments, referred to herein as "Swap Divisi," solve the problem of high voice count, while still maintaining a relatively faithful orchestral sounding. Although it still uses separate recordings of the individual divisions of a section (i.e., as one or a few players of an instrument section of an orchestra), it also uses additional recordings of the ensemble as a full section, of larger subdivisions of that full ensemble, or both. It then sounds only the relevant groups of players based on the current number of notes allocated to the section. In this respect, an orchestra is a large instrumental ensemble that contains sections of string, brass, woodwind, and percussion instruments. When in proper context, the reference herein to a "section" or to a "sub-section," relates to such orchestral sections as sections of string, brass, woodwind, and percussion instruments.

Swap Divisi offers multiple advantages. Prior Divisi processes imposed heavy workload and bandwidth demands on the required hardware because all of the related, discretely recorded samples (and groups of samples) had to play simultaneously. Swap Divisi eliminates this requirement while effectively preserving most of the benefits of the author's earlier Divisi processes (realistic volume and voice changes as notes are added or removed from a chord). Swap Divisi also allows an infinite level of scalability. In its simplest implementation, it can be used with as little as two discrete groups of audio samples (for example, the 2-way swap Divisi method could be used with an audio sample group consisting of 2 instruments recorded simultaneously, and an audio sample group of just one of these instruments recorded individually). By increasing the number of divisions to 3, 5, 7 and even more, greater realism may be attained with a trade-off of the need for somewhat more processing power (not much more) and an increasing number of audio samples which, in turn, occupy more storage space.

To demonstrate the scalability of this invention, we provide examples of its behavior with varying numbers of audio sample groups in the included drawings. One can correctly infer from studying these examples that the process also can be extended beyond the 7-way example to as many groups of audio samples as the user of this process deems appropriate. While the examples provided herein are of orchestral instruments, this process can be applied to virtually any type of recorded or synthesized sounds such as percussive instruments or even sound effects.

According to various embodiments, a system for recreating orchestral sounds is provided, the system comprising: stored recordings of musical instruments, the recordings comprising, for each note, a recording of a full section comprising a plurality of x musical instruments and at least one recording of a sub-section comprising less than x musical instruments; an input device enabling a user to enter a "note on" and "note release" commands for notes at various pitches; a note allocation processor receiving inputs from the input device and preprogrammed to allocate a first received "note on" command to the section, and to allocate subsequent "note on" commands to the sub-section whenever the section is concurrently sounding a note. The full section may or may not correspond to a full orchestral section. The section may be one of string, brass, woodwind, or other orchestral section, etc.

To enhance the faithful recreation of the orchestral sound, the allocation processor is further preprogrammed to reduce the volume of the section when allocating a "note on" to the subsection. Also, to provide rich sound experience, several subsections may be recorded for each note. For example, a first sub-section may be of a size half that of the section, a second sub-section may also be half the size of the full section, but be of instruments complimentary to the first subsection. Further sub-sections may comprise a quarter of the size of the full section. Further, any of the sub-sections may comprise a single instrument. In certain embodiments, the recordings further comprise ambient recordings, wherein each ambient recording corresponds to a recording of a section or subsection ceasing to play a note, and may include the sounds coming from the echo chambers of the instruments, reflections from walls, continued vibration of strings, etc. In such embodiments, the note allocation processor is further preprogrammed to, when receiving a "note release" command from the input device, determine which full section or sub-section is sounding a corresponding "note on", and assigning the "note release" to that section or sub-section.

In order to properly allocate "note on" and "note off" commands, the note allocation processor may also include a held note table, wherein "note on" allocations are tabulated according to their assignment to full or sub-section. Additionally, the note allocation processor may also include a "note on" counter, which is incremented each time a "note on" command is received from the input device. The allocation processor may be preprogrammed to interrogate the note on counter in order to determine whether the "note on" command is a first note to be sounded, in which case the note allocation processor would allocate the note to the full section, or whether the "note on" command is a subsequent note to be sounded, in which case the note allocation processor would allocate the note to a sub-section.

According to certain embodiments, a computerized method is provided for sounding notes triggered by an input device coupled to a processor, the method comprising: receiving at the processor a first "note on" input from the input device; assigning by the processor the first note to be sounded by a group of designated instruments; receiving at the processor a subsequent "note on" input from the input device; and, assigning by the processor the subsequent note to be sounded by a sub-group comprising a smaller number of the designated instruments. The method may further comprise, upon assigning the subsequent note, reducing sounding volume of the first note. The method may be implemented wherein the sub-group is chosen from a plurality of available sub-groups, each of the plurality of available sub-groups comprising a smaller number of the designated instruments. Also, at least one of the plurality of available sub-groups may comprise half number of the designated instruments, and at least one of the plurality of available sub-groups may comprise a quarter the number of the designated instruments. The method may further comprise: receiving at the processor a "note off" input from the input device; determining whether pitch of the note off input corresponds to the first "note on" or the subsequent note on; when the pitch corresponds to the first note on, ceasing sounding by the group of designated instruments and boosting volume of any sounding sub-group; and, when the pitch corresponds to the subsequent note on, ceasing sounding by the sub-group sounding the subsequent note. The method may further comprise: when the pitch corresponds to the subsequent note on boosting volume of the first note. The method may further comprise: upon ceasing sounding by the group of designated instruments, activating a "note release" sound corresponding to the group of designated instrument; and upon ceasing sounding by the sub-group, activating a "note release" sound corresponding to the sub-group. The "note release" may be a sample of ambient sound of a note released by corresponding musical instrument. The group of designated instruments may comprise a sampling of an orchestral section and the sub-group comprises a sampling of a fraction of an orchestral section.

According to further embodiments, a program configured is for, when executed on a processor, cause the processor to perform note allocations to a section or to a sub-section, by executing the functions comprising: receiving a "note on" input; interrogating a first decision block to determine whether the section is already assigned a note and, when the section is not already assigned a note, assigning the "note on" input to the section; when the section is already assigned a note, assigning the "note on" to the sub-section; and, wherein the section comprises a sounding of x number of musical instruments and the sub-section comprises a sounding of no more than x−1 musical instruments. The program may further comprise, upon assigning the "note on" to the sub-section, decreasing sounding volume of the section. The may further comprise, upon assigning the "note on" to the sub-section, interrogating a second decision block to determine whether the sub-section is already assigned a note and, when the sub-section is not already assigned a note, assigning the "note on" input to the sub-section; when the sub-section is already assigned a note, assigning the note to a partial-section, wherein the partial-section comprises a sounding of no more than x−2 musical instruments. The program may further comprise, upon assigning the "note on" to the partial-section, decreasing sounding volume of at least one of the section and the sub-section. The sub-section may comprise x/2 musical instruments and the partial section may comprise x/4 musical instruments. The program may further comprise maintaining a table of all notes currently being assigned. The program may further comprise maintaining a counter of number of notes currently being assigned. The may further comprise maintaining an additive polyphony counter indicating concurrent sounding of multiple notes. The program may further comprise prior to interrogating the first decision block, determining whether pitch of the "note on" is within pitch range of musical instrument of the section and, when the pitch of the "note on" is outside of the pitch range, ignoring the "note on" input. The program may further comprise: receiving a "note release" input; interrogating a first decision block to determine whether the "note release" corresponds to "note on" assigned to the section; when the "note release" corresponds to "note on" assigned to the section, removing the assigned "note on" from the section and assigning a "note off" to the section; when the "note release" does not correspond to "note on" assigned to the section, removing the assigned "note on" from the sub-section and assigning a "note off" to the sub-section; and wherein the "note off" comprises an ambient sounding of a musical instrument ceasing to play a note. The section may comprise a first group of instruments having a first pitch range and a second group of instruments having a second pitch range lower than the first pitch range, and wherein the sub-section comprises the first group of instruments and further comprising a second sub-section comprising the second group of instruments; and, wherein when the section is already assigned a note, assigning the "note on" to the sub-section or to the second sub-section according to the pitch of the note on.

BRIEF DESCRIPTIONS OF THE DRAWINGS

Other aspects and features of the invention would be apparent from the detailed description, which is made with reference to the following drawings. It should be appreciated that the detailed description and the drawings provide various non-limiting examples of various embodiments of the invention, which is defined by the appended claims.

The accompanying drawings, which are incorporated in and constitute a part of this specification, exemplify the embodiments of the present invention and, together with the description, serve to explain and illustrate principles of the invention. The drawings are intended to illustrate features of the exemplary embodiments in a diagrammatic manner. The drawings are not intended to depict every feature of actual embodiments nor relative dimensions of the depicted elements, and are not drawn to scale.

FIG. 1 is a high-level schematic drawing of an embodiment of the elements used to implement Swap Divisi.

FIGS. 2*a* and 2*b* are visual representations of some of the possible recorded sample groups that can be used with 2-way, 3-way, 5-way, or 7-way implementations of Swap Divisi.

FIGS. 3*a* and 3*b* are examples of user-defined variables for playing range and added-note-attenuation, just two of many such variables that can be used to customize and refine the way Swap Divisi functions.

FIG. 4 is a visualization of how the Held Note Table component of the Note Allocation Processor can store note information for a particular instance of Swap Divisi.

FIGS. 5*a*-5*d* are flow diagrams showing the Note allocation process of Swap Divisi when used with two discrete audio sample groups.

FIGS. 6*a*-6*d* are flow diagrams showing the Note allocation process of Swap Divisi when used with three discrete audio sample groups.

Figure 1:
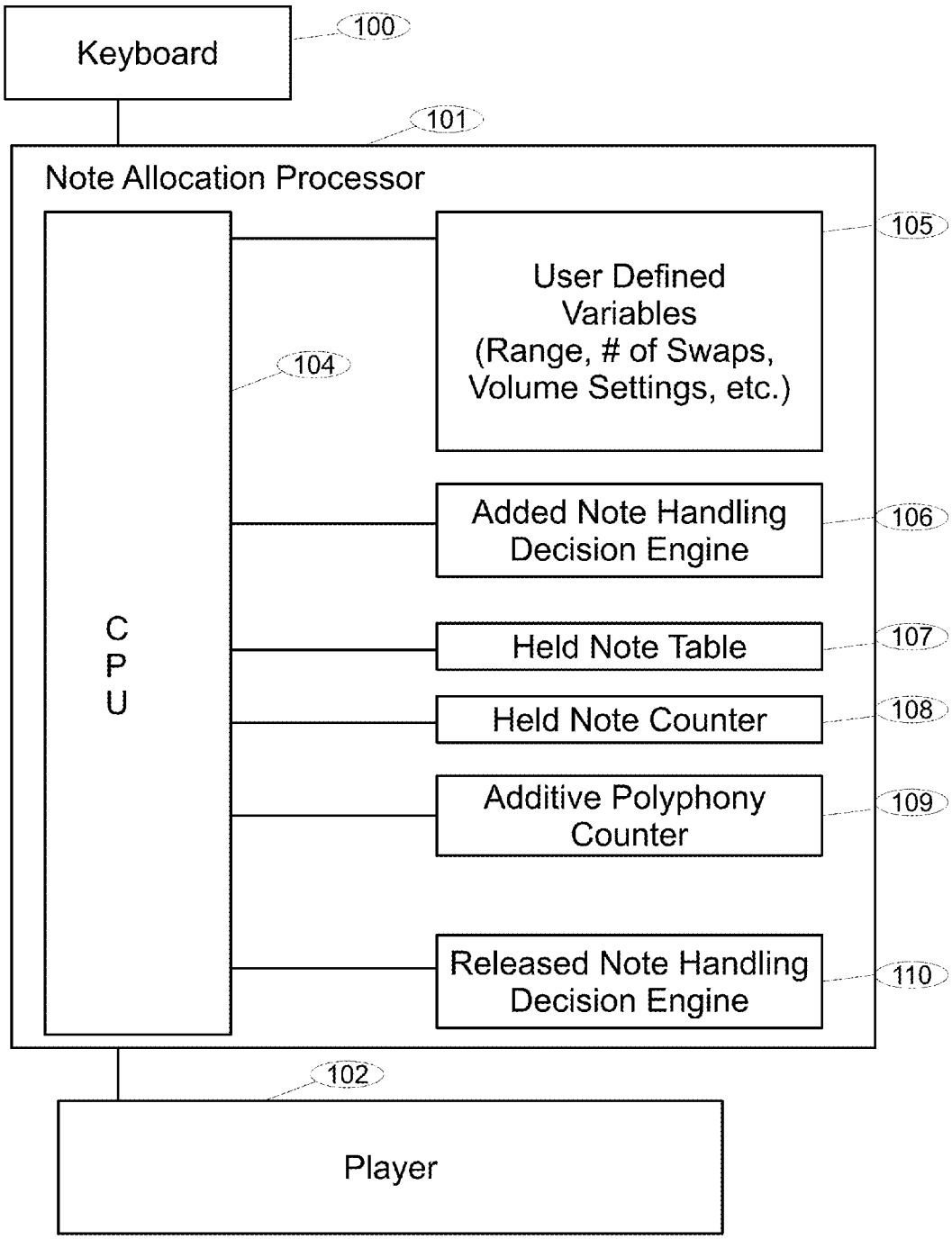

FIGS. 9*a*-9*g* are schematic illustrations of assignment of notes played on a keyboard to a sampling of instruments.

DETAILED DESCRIPTION

Overview

As exemplified in the below disclosed embodiments, Swap Divisi is a real-time computer optimization process that solves three major problems facing the live performance sampled instrument music industry. These problems are digital voice overload: the stress on a single computer streaming multiple sampled musical instruments all playing at the same time; sound-power build-up: the unnatural volume increase of compiled digitally sampled instruments; and additive polyphony: multiple digitally sampled instruments increase exponentially with each note played in a chord. Additive polyphony results in an unnatural, organ-like sound. These problems do not exist in the live orchestra world; they are unwanted artifacts of the digital audio world as it attempts to mimic a live orchestra. The disclosed embodiments of the Swap Divisi process solve all three issues in a single process.

Digital Voice Count Overload

The greater number of conventionally sampled instruments a musician plays at the same time, plus the more notes in a chord he plays, the more computing power he requires. Digital voice count overload occurs when the computer cannot meet these needs. It results in crackle in the speakers and can lead to computer crashes.

In a studio environment, musicians avoid this problem by laboriously recording one note at a time. However, live musicians don't have this luxury, and often exceed their computer's voice count ability. Embodiments of Swap Divisi fix digital voice count overload by playing a single sample of combined multiple instruments on the first note. As more notes are added, Swap Divisi automatically swaps in and out varying combinations of instruments, called a group, so that there will never be more digital voices playing than a single conventionally sampled instrument playing the same number of notes.

Sound-Power Buildup

In a live orchestra as more notes are added in a chord, the musicians divide the notes amongst themselves: some players play the high notes while others play the lower notes. Since an orchestra has a fixed number of players, there is no sound-power buildup, no matter how many notes are played. However with a digitally sampled orchestra, this is not the case.

Usually, a digitally sampled instrument is actually a recording of more than one of the same instruments. Imagine a musician playing a chord by pressing three of his fingers on the keyboard at the same time. If each note of the chord is actually a digitally sampled recording of ten violins, a three-note chord results in the sound and volume of thirty violins causing sound-power buildup. Swap Divisi solves this problem by gradually attenuating the appropriate Swap Divisi groups as more notes are added. The result: ten notes have the same sound-power as one note, just like in a real orchestra.

Additive Polyphony

Another artifact of sound-power buildup is additive polyphony. As the instruments multiply with each note played in a chord, not only does the sound get louder, it also loses its unique sonic character.

Now consider that the rest of the String Section (violas, celli, and bass) is sampled just like the violins. When a musician plays a chord on his keyboard using conventionally recorded samples of the entire string section, the result is sound-power buildup and additive polyphony, since each note is played by the entire recorded string section. The string sections sounds more like an organ than a live string section. Moreover, the sound is unnatural since in live performance the entire string section cannot play each of the notes simultaneously.

Additive polyphony is one of the prior art problems that swap divisi solves. However, in certain disclosed embodiments certain notes may be sounded as additive polyphony when the particularly implemented algorithm exceeds it's limitations. In these embodiments additive polyphony is allowed because it is more problematic to play a note that does not make a sound when it should, vs. a note that sounds as additive polyphony or somewhat unnatural.

For example, when implementing a 3-way swap divisi with a division of 2 solo brass instruments, technically these two instruments can only play 2 notes at any given time in the real world. That is, they either both play the same note as a section, or each play a different note for harmony. However, when implementing sampling, if a user plays 3 or more notes on the keyboard, it would be uncertain which of the 3 notes would actually play, since in reality only two notes can be sounded by these two brass instruments. Moreover, it would be disturbing for the user to hear one note missing from the notes the user is trying to play. Therefore, in disclosed embodiments additive polyphony is enabled and allowed, so as to make sure that whatever is played on the keyboard still makes a sound as expected.

In the disclosed embodiments, additive polyphony notes are, for all practical purposes, identical to their A or B section counterparts as far as volume attenuation and/or boosting and release group selection is concerned. Also, as an added feature providing an aid to the user, certain disclosed embodiments incorporate an additive polyphony counter. The additive polyphony counter can be used for testing to determine a practical amount of swap divisi groups. For example, while notes shown in the drawings are sounding, certain embodiments implement a readout that displays the number of additive polyphony notes at any given time. This enables the user to be able to see how many levels of swap divisi are necessary in a given situation. A great example of this is using a combination of standard divisi across 5 string sections, and using swap divisi within each string section. In this scenario, it's actually very difficult to reach additive polyphony when using 3-way swap divisi on each string section. Therefore, in disclosed embodiments additive polyphony is a "last resort" to make sure that everything played on the keyboard makes a sound, and the additive polyphony counter is a tool to make sure that additive polyphony is avoided whenever possible.

Note Release

When a player releases a note, e.g., lifts a finger off a key, the simplest implementation is to simply stop sounding that note. This can be experienced by playing a simple keyboard, wherein when a finger is lifted, no more sound can be heard. However, performing such an operation on soundings of various instruments may lead to an unnatural experience. There are various instruments that continue to sound or have certain "ambiance sound," such as echo from the sound chamber, reflections from the hall's walls, etc., when the player ceases to play. Therefore, in the embodiments described below, examples of release note processes are provided that include the sounding of "note release" specific to the section that had been playing that note. In the context of a sampler, the "note release" sounding may include a separate sample of the section which captures the natural ambiance sound of a note released by that section. In the context of a synthesizer, the "note release" sounding is simply a synthesized sounding of the natural ambiance sound of a note released by that section. While the Swap Divisi may be implemented without the note release feature, for completeness all of the embodiments described include a process to perform note release, thus providing a more natural experience.

When implementing a note released process, when a note release event occurs, the note-off message may be handled by performing two operations: 1. Stopping the original note from playing; and, 2. triggering another sample/synthesis in a separate group that performs the "release note" sounding. This sample (referred to as a release sample) is a recording of the ambience a person would hear at the end of a note. Each Swap Divisi division or section has its own discrete set of release samples.

When implementing Swap Divisi without the use of release samples (i.e., step 2), the "note-off" process would not be needed. However, when using release samples with Swap Divisi, the note-off process is needed for the following reasons:

1. To determine which release group to trigger, so that only one release sample plays. When a typical sample player engine receives a note-off message, it has no way of knowing which group the released note belongs to, so it simply triggers all groups that are designated as release groups.
2. Choosing the correct release sample group that matches the sonic character and volume of the note being released. This becomes important when dealing with Swap Divisi ensembles that involve different types of instruments. For example, if a 3 way Swap Divisi ensemble has a Saxophone and a Clarinet, then the full section would be Sax plus Clarinet, A Section: Sax, and B Section: Clarinet. Due to the difference in sonic character of these instruments, it will not sound right if the note being released were played by the Clarinet (B group), but the release sample is played from the Saxophone (A group).

Two-Way Swap Divisi

Figure 9C:
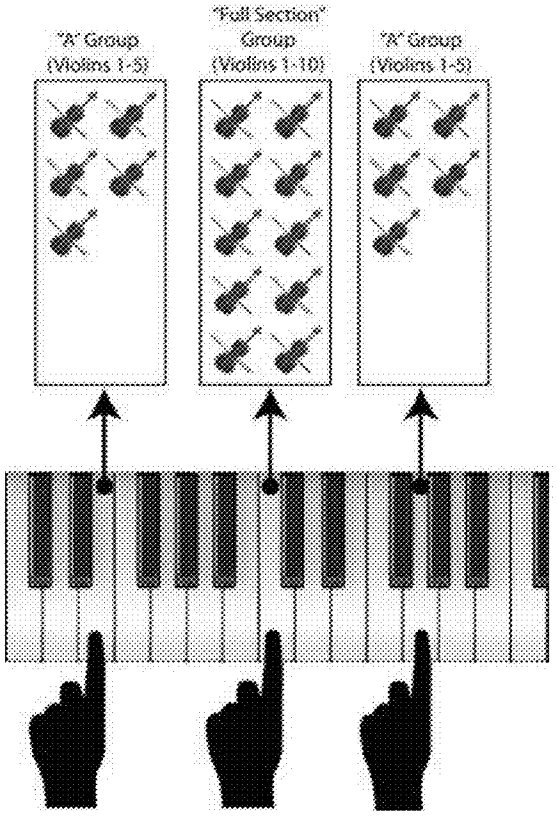
Figure 9B:
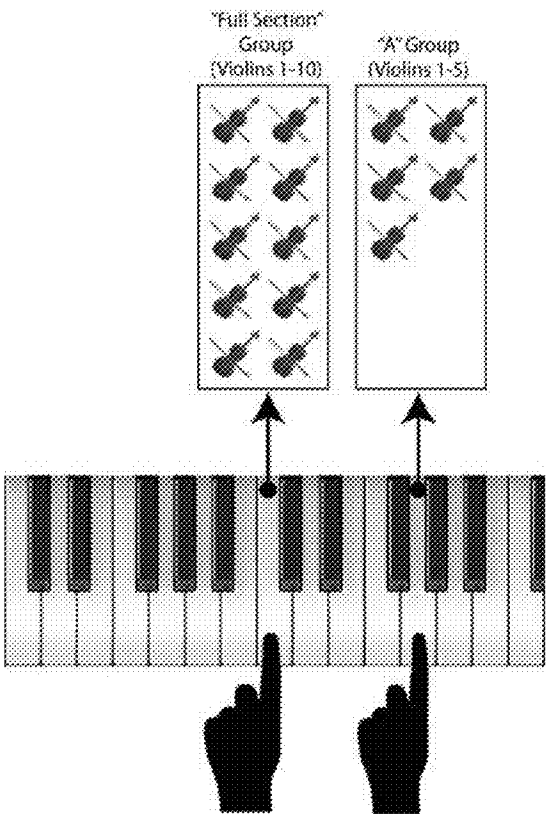
Figure 9A:
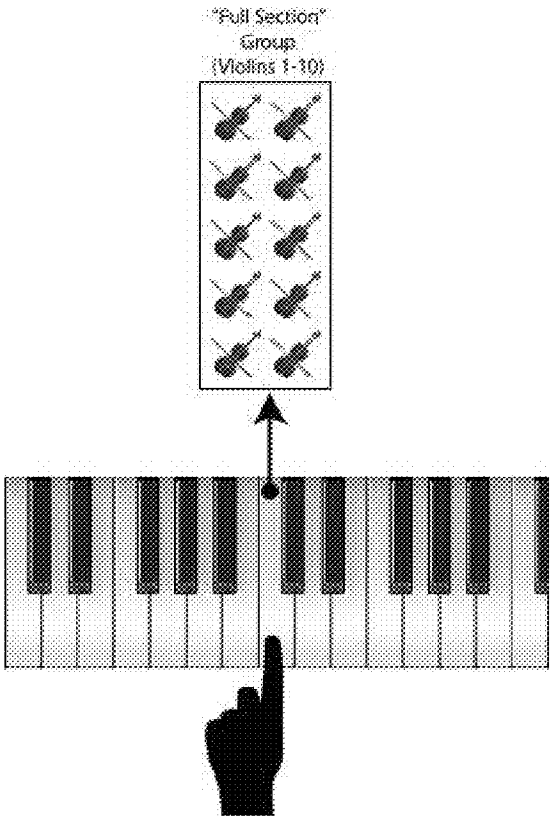

When a musician plays one note on his keyboard, he hears a single combined recording, called the Full Section group. In this example, the Full Section group is a recording of ten violins (FIG. 9A). When two notes are played simultaneously (FIG. 9B), Swap Divisi keeps playing the Full Section group and automatically adds a second group, referred to as the "A" group, to play the added note. In this example the "A" group consists of a single recording of five violins, and it is digitally recorded at an appropriate lower volume in relation to the Full Section group. As the second note is added, Swap Divisi reduces the volume of the Full Section group to a specific amount so that the volume of the Two notes together does not exceed the volume of the first note played. When a third note is added (FIG. 5C), the "A" group also plays the added note and an additional volume reduction is applied yet again to ensure that the volume of the three notes together does not exceed the volume of the first played note.

As more notes are added, the highest pitched note is kept slightly louder than the other notes to preserve the melody, and the Full Section group continually attenuates in volume so that even with the addition of more notes, a constant volume is maintained. The combination of constant volume compensation as notes are added combined with the correct number of instruments in the "A" group creates a realistic divisi sound. Swap Divisi allows the musician to add or subtract as many notes in a chord as needed while still maintaining both the correct volume and the correct number of instruments distributed to each note. Two-Way Swap Divisi is the simplest Swap Divisi process. It is ideal for portable medium devices where RAM and hard disc footprint is a critical issue.

Three-Way Swap Divisi

The significant difference between Two-Way Swap Divisi and Three-Way Swap Divisi is that in addition to the "A" group, there exists a "B" group. In this example, the "A" group is a recording of violins 1-5 and the "B" group is a recording of violins 6-10. Why does this matter? The physical position of each violin in the recording studio has its unique sound quality. If you were to play just the "A" group alone and then the "B" group alone you would hear a noticeable difference in their sound; the "B" group would sound slightly farther away. It is these subtle acoustic differences between the "A" and the "B" group that further adds to divisi realism. That is, group B is sampled to sound farther away from the listener than group A.

Figure 9D:
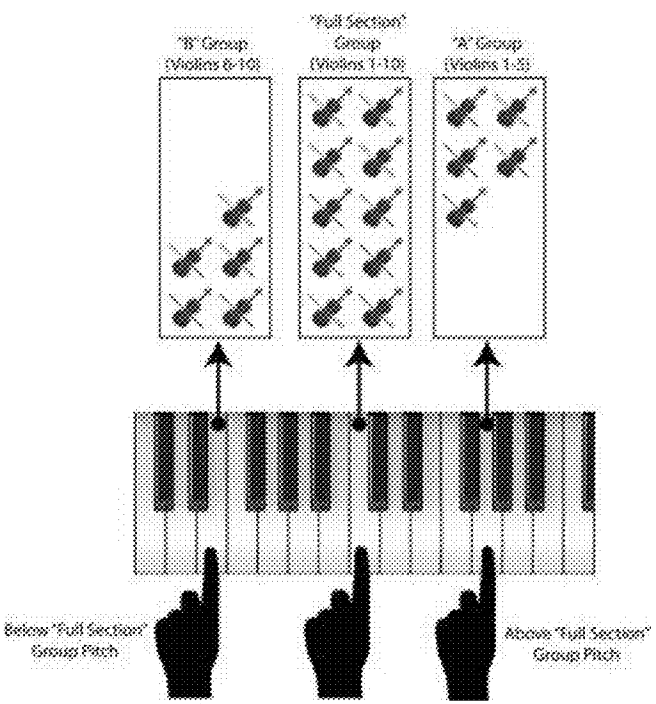
Figure 9E:
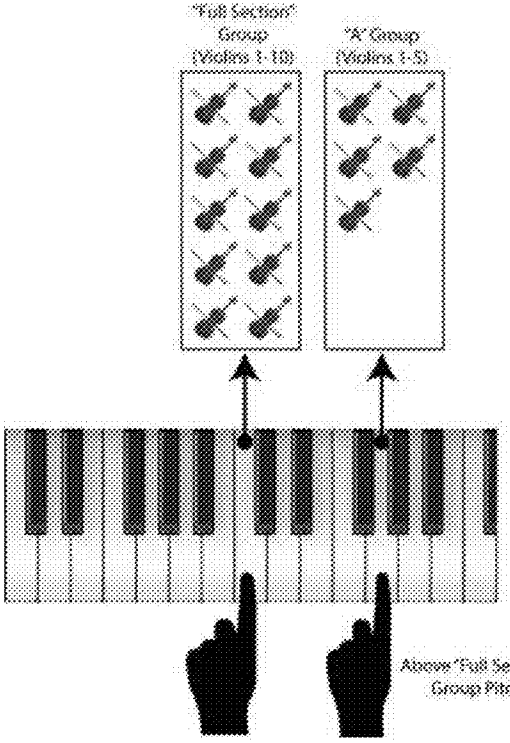

The three-Way Swap Divisi process starts out the same as Two-Way Swap Divisi, where the Full Section Swap Divisi group plays the first note. When notes are added, Swap Divisi detects whether they are played above or below the pitch of the first note played. If the notes are higher in pitch than the Full Section group then Swap Divisi selects the "A" group to sound those notes (FIG. 9D). Swap Divisi selects the "B" group to sound all notes played below the pitch of the Full Section group (FIG. 9E).

Similar to Two-Way Swap Divisi, volume attenuation compensation is applied as more notes are added. As you would expect, the more sub-groups you have in the algorithm, such as "A", "B", "A1" and "B1" groups, the more realistic the divisi sound as you increase the number of held notes in a chord. For this reason we use a combination of Two-Way and Three-Way Swap divisi to generate an infinite number of sub-groups called "Extended Swap Divisi."

Extended Swap Divsi

By using various combinations of Two-Way and Three-Way Swap Divisi, an entire section can be divided up by as many divisions as there are instruments. While there is a certain practical limit to the number of sample groups used, the number of Two and Three-Way Swap Divisi processes combined is limited only by the number of instruments used.

Figure 9G:
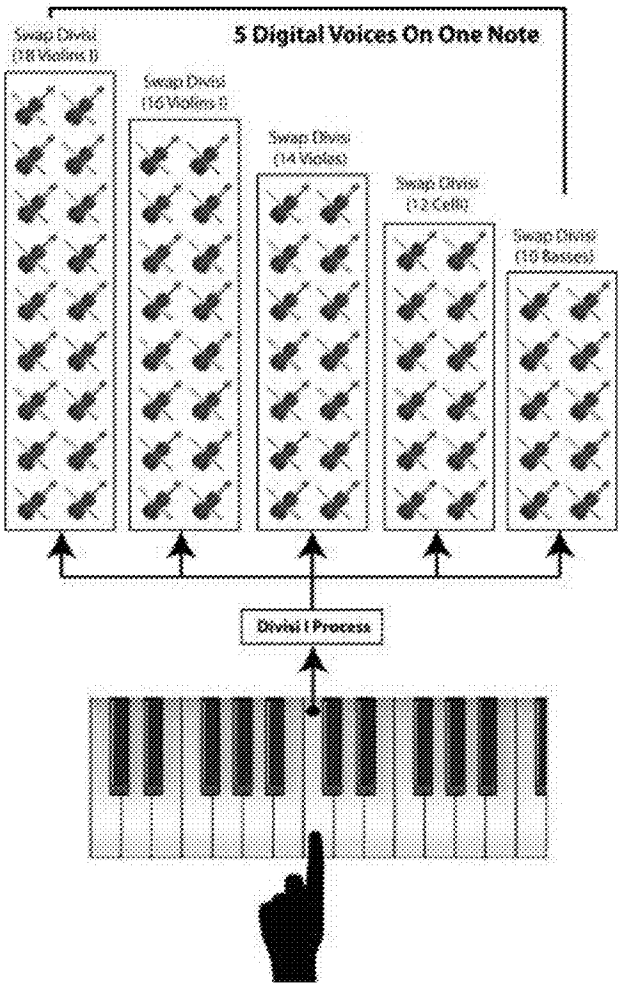
Figure 9F:
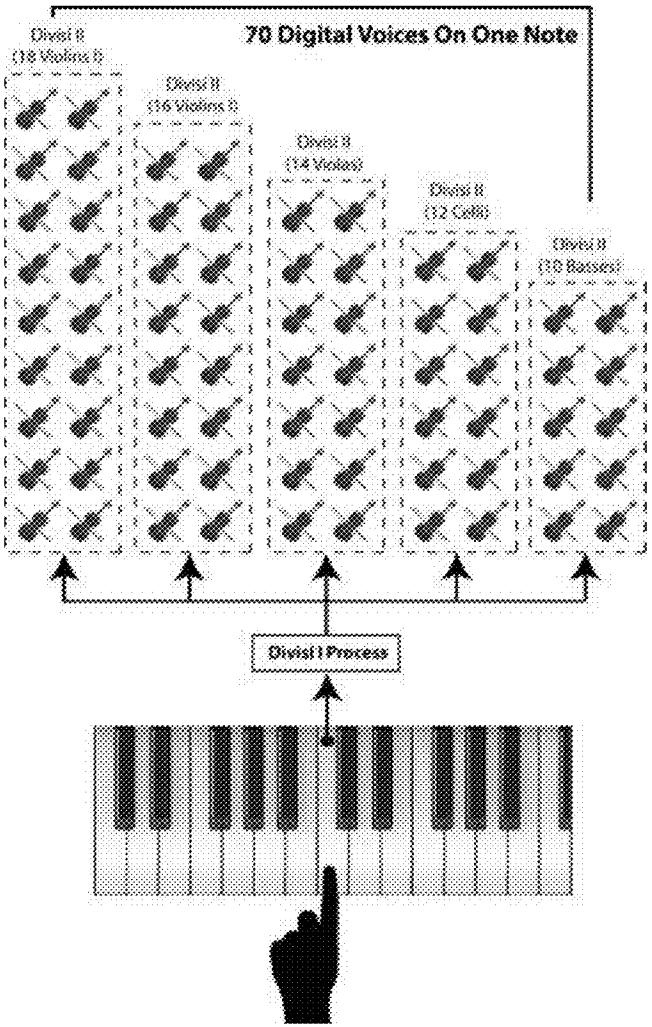

FIGS. 9F and 9G illustrate a comparison of prior art Divisi, wherein each instrument is sampled and voiced individually, and Swap Divisi, wherein groups of instruments are sampled and voiced. FIGS. 9F and 9G illustrate an example of a typical scenario where Divisi processing is used to play an entire string section. In FIG. 9F, each string instrument icon is a representation of one digital voice, or one sampled instrument. The sum of these adds up to seventy digital voices on one note alone, which is highly digital voice intensive. In such an example, regardless of the number of notes the user plays, the processor must provide seventy digital voices.

On the other hand, the illustration of FIG. 9G shows the same musical application, only this time using the Swap Divisi process. It is important to notice that the string instrument icons in this illustration are combined into a single group per sub-section. This means that each sub-section only demands one digital voice when playing just one note. The total is only five digital voices as opposed to seventy. The number of voices would increase as an increasing number of notes are played, but the increase is relatively small compared to the seventy voices required for the illustration of FIG. 9F.

Exemplary Embodiments

FIG. 1 illustrates one embodiment for implementing Swap Divisi. This embodiment includes a user input device 100, e.g., a keyboard, a note allocation processor 101, and a note player 102, e.g., a synthesizer or a sampler. In this particular embodiment, 100 will be described as a MIDI keyboard, although any device capable of generating notes such as an ASCII keyboard or a MIDI sequencer could also be used to generate the note data that processor 101 will use for its calculations. In accordance with MIDI technology, which is a serial-based technology, even though several notes could theoretically be created simultaneously by 100, we assume that they will always be processed by the Note allocation processor sequentially. For example, if all 3 notes of a 3-note chord are "played" (triggered) at the exact same time on input device 100, the Note allocation processor 101 will still treat them as if they occurred at slightly different times, and as such will process the 3 notes individually as a first note, a second note, and a third note based on the order in which it processes them.

The Note Allocation Processor 101 includes: CPU 104, User adjustable Variable memory 105, Added Note Handling Decision Engine 106, Held Note Table 107, Held Note Counter 108, Additive Polyphony Counter 109, and Released Note Handling Decision Engine 110.

Note Allocation Processor 101's primary purpose is to determine to which group of samples a note should be allocated. Depending on several conditions such as the number of notes held (whereby "held notes" is in the musical sense of continuing to play the note which is to say "holding a key down so the note is sustained"), whether certain groups are already playing a note, and the note's relationship to other notes currently held. The Note Allocation processor also determines necessary volume adjustments to the active groups in order to maintain a consistent volume level as notes are added to or released from a held chord.

User Adjustable Variables 105, which may be preset by the supplier of the system and then may or may not be altered by the system user, are values used as a basis for the calculations that the Note Allocation Processor 101 makes to determine the correct group assignments and volume adjustments.

Held Note Table 107 is used to store information about a note as it is played. Once the Added Note Handling Decision Engine 106 has determined the group to which the note needs to be assigned, the note's MIDI note number (MIDI note number defines a unique pitch ID for each note) is stored in Held Note Table 107 along with a reference to the group of audio samples to which it has been allocated. The Held Note Table 107's architecture can be thought of as an array with a finite number of "slots." Each "slot" is directly associated with an available group of audio samples, and a slot stores information about any note allocated to its specific group of audio samples.

Held Note Counter 108 is a simple counter that maintains a count of the actual quantity of notes that are currently being held. When a note is added to a held chord, the counter increases by 1; when a note is released from a held chord, the counter decreases by 1.

Additive Polyphony Counter 109 keeps count of notes that are assigned to additive polyphony. Additive polyphony occurs when a note is added to a chord, and the Added Note Handling Decision Engine 106 determines that this new note should be allocated to a "slot" in Held Note table 107 which already contains an active note.

The Added Note Handling Decision Engine 106 relies on data from the note pitch of an added note received from the input device 100 and compares it with user adjustable variables 105, Held Note Table 107, Held Note Counter 108, and the additive polyphony counter 109 to determine the specific group of audio samples to which the note should be assigned, and to determine what volume adjustments should be performed, if any, to each of the active groups of audio samples. Note that the actual decision making process for 106 will vary depending on the number of swap groups used. Examples of how 106 determines the correct group are given below. In general, when a note is added, at least one group will need to be decreased in volume to compensate for the overall increase in volume otherwise caused by the addition of the instrument (s) sounding another note.

The Released Note Handling Decision Engine 110 compares a released note's pitch to all notes available in the Held Note Table 106. If the released note's pitch matches any of the notes stored in the Held Note Table 106, the Released Note Handling Decision Engine 100 then removes the note from the Held Note Table 106, and uses the count of the Held Note Counter 107 and the note data for the other remaining notes in the Held Note Table 106 to determine the correct volume adjustments needed, which are then selected from the User Adjustable Variables 105. In general, when a note is released, at least one group will need to be increased in volume to compensate for the reduction in overall volume caused by the removal of a note.

For the purpose of this example, the Note Player 102 is a software sample player engine designed to play back digital audio files when triggered via MIDI note input.

Figure 2A:
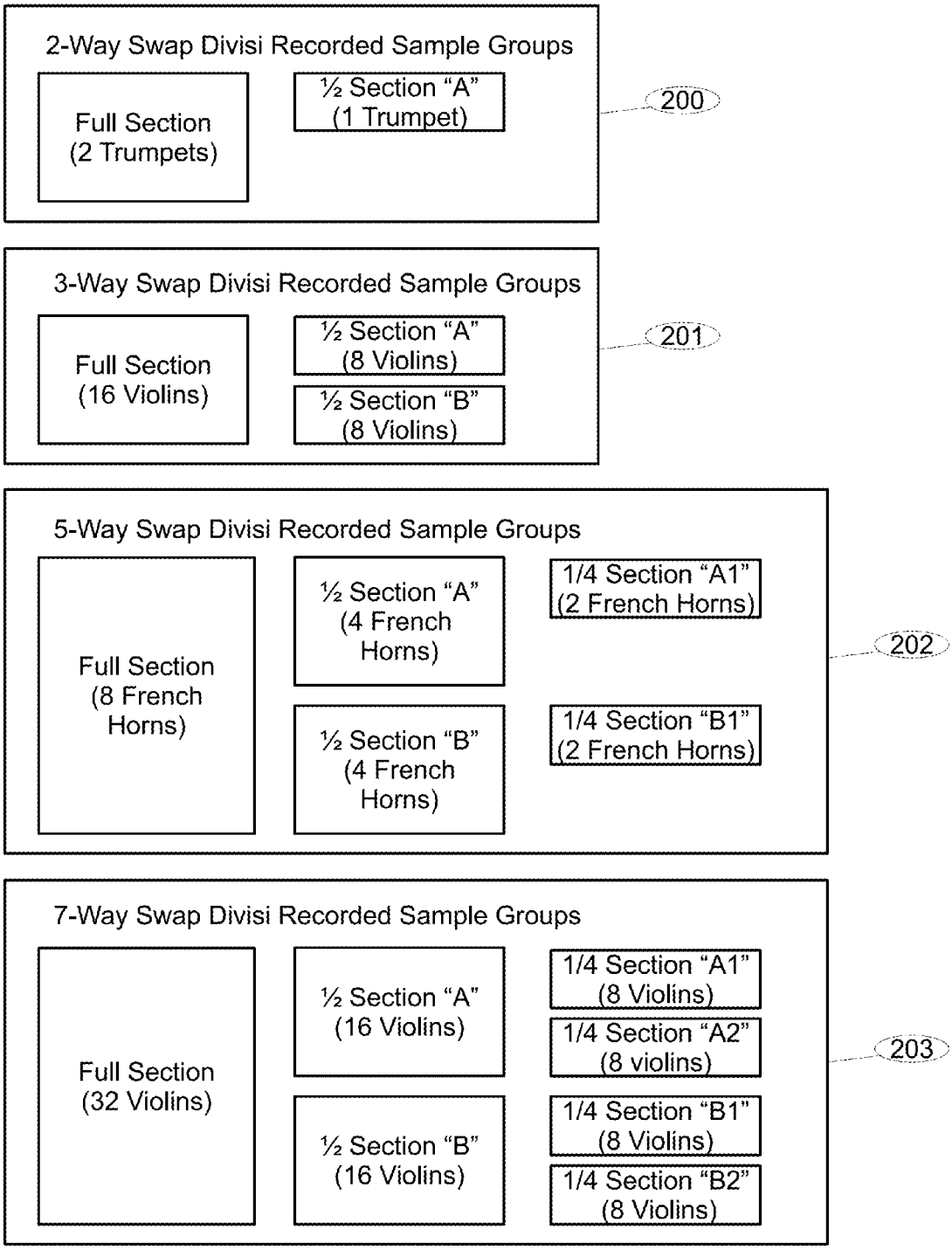
Figure 2B:
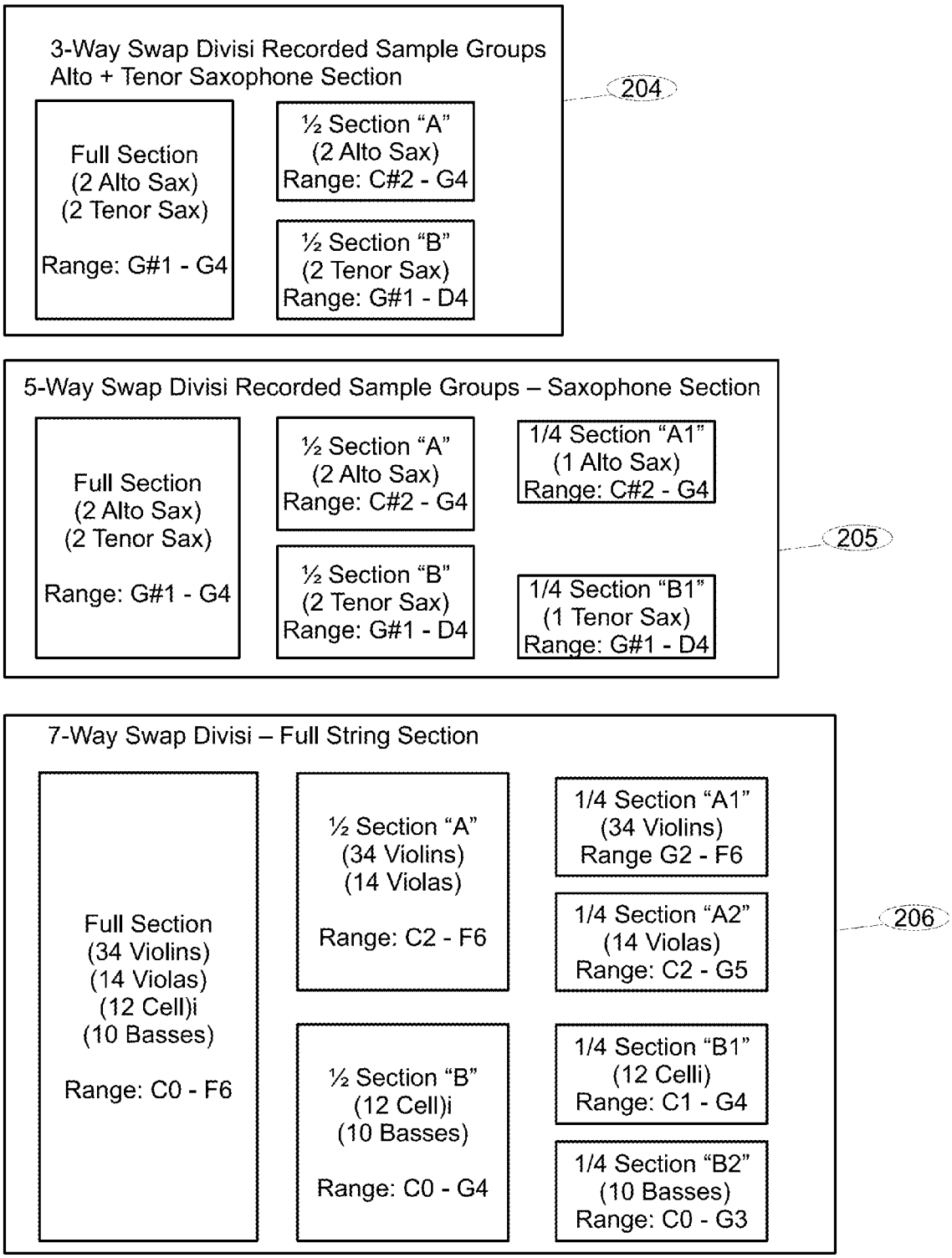

FIG. 2*a* illustrates examples of possible sample groups used for Swap Divisi in 2-way, 3-way, 5-way, and 7-way modes where the note range (frequency range) of all groups is identical. FIG. 2*b* illustrates examples of possible sample groups used for Swap Divisi in 3-way, 5-way, and 7-way modes where the note range of the division groups is different.

The Swap Divisi process can be used with any number of audio sample groups. These groups are generally recorded as a section of instruments. A simple example of Swap Divisi's use involves 3 audio sample groups: the first group consists of a recorded audio sample of 2 trumpets, and the other two groups each consist of recordings of a unique solo trumpet (ideally these two sample groups are the same two individual instruments used to create the recorded ensemble of two trumpets). This implementation, using 3 sample groups, will be referred to throughout this document as 3-way Swap Divisi. However, the use of the Swap Divisi process is not restricted to 3 groups, and can be implemented with various numbers of sample groups. This document describes the use of the swap Divisi method using 2-way, 3-way, 5-way, and 7-way Swap Divisi methods. Each method has certain advantages, as the following paragraphs discuss.

2-way Swap Divisi is shown in FIG. 2*a*, 200. It requires only 2 audio sample groups, typically one group comprised of audio samples from 2 or more instruments recorded simultaneously (the Full Section), and a second group comprised of audio samples from half the instruments in the first group. FIG. 2*a*, 200 illustrates this 2-way Swap Divisi using an audio sample group of 2 Trumpets for the full section, and 1 trumpet for the half-section (Labeled Section "A"). With 2-way Swap Divisi, both groups must use the same note range, so it is best used with ensembles of instruments that have an identical range.

3-way Swap Divisi is revealed in FIG. 2*a*, 201 or FIG. 2*b*, 204. Since it uses two half sections (nominally labeled "A" and "B"), these can have different note ranges. An example of instrument choice using divisions of differing ranges can be seen in FIG. 2*b*, 204 where the full section group uses a combination of 2 alto and 2 tenor saxophones. The full section is divided so the "A" group uses the 2 alto saxophones, and the "B" group uses the 2 tenor saxophones. 3-way swap Divisi can, of course also be used in a situation where the "A" and "B" groups use the same range as the full section, as demonstrated with a Violin Section in FIG. 2*a*, 201.

5-way Swap Divisi extends the 3-way method to include two quarter section groups which are each typically recordings of half of the "A" and "B" (half section) groups. In 5-way Swap Divisi, a quarter section group must use the same range as its associated half section, but the two half sections can still have differing ranges, as demonstrated in FIG. 2*b*, 205 which consists of a full section of 2 alto and 2 tenor saxophones, an "A" half section consisting of 2 alto saxophones, a "B" half section consisting of 2 tenor saxophones, an "A1" quarter section consisting of 1 alto saxophone, and a "B1" quarter section consisting of 1 tenor saxophone. S-way swap Divisi can also be used when all 5 groups use an identical range, as shown with a section of 8 french horns in FIG. 2*a*, 202.

7-way swap Divisi includes a full section, two half sections, and four quarter sections. Two of the quarter sections are a division of the A half section, and the other two are a division of the B half section. 7-way swap Divisi allows the possibility of each of the 4 quarter sections having a different note range. This is ideal for divisions of a large ensemble of instruments such as a full 70-piece string section as shown in FIG. 2*b*, 206. Like the 2-way, 3-way, and 5-way methods, 7-way swap Divisi can also be used in situations where all of the half and quarter section divisions use the same range as the full section, as shown in FIG. 2*a*, 203.

Figure 7:
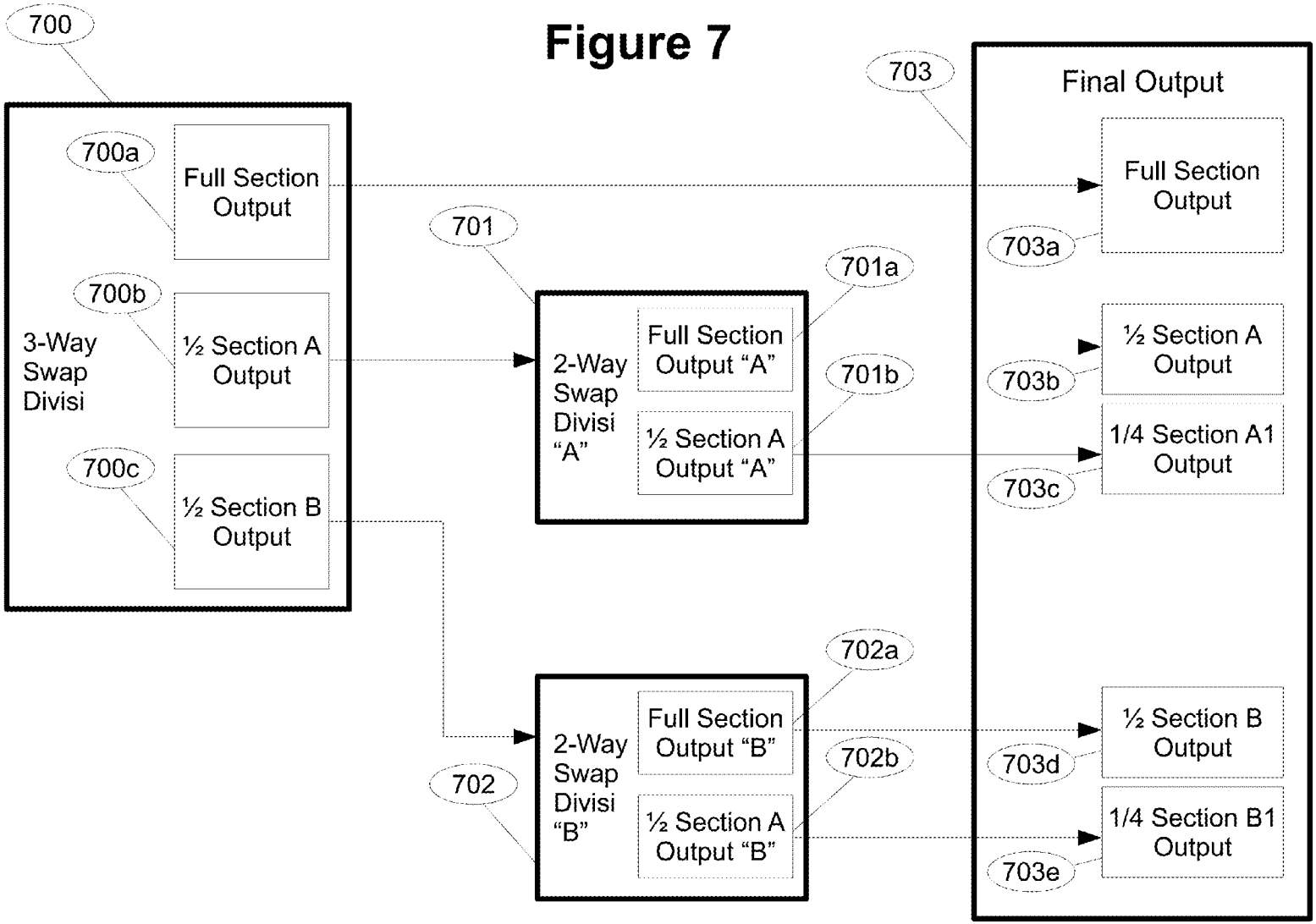
FIG. 7 is a high level flow diagram showing the use of one instance of 3-way Swap Divisi and two instances of 2-way Swap Divisi with five discrete audio sample groups.
Figure 8:
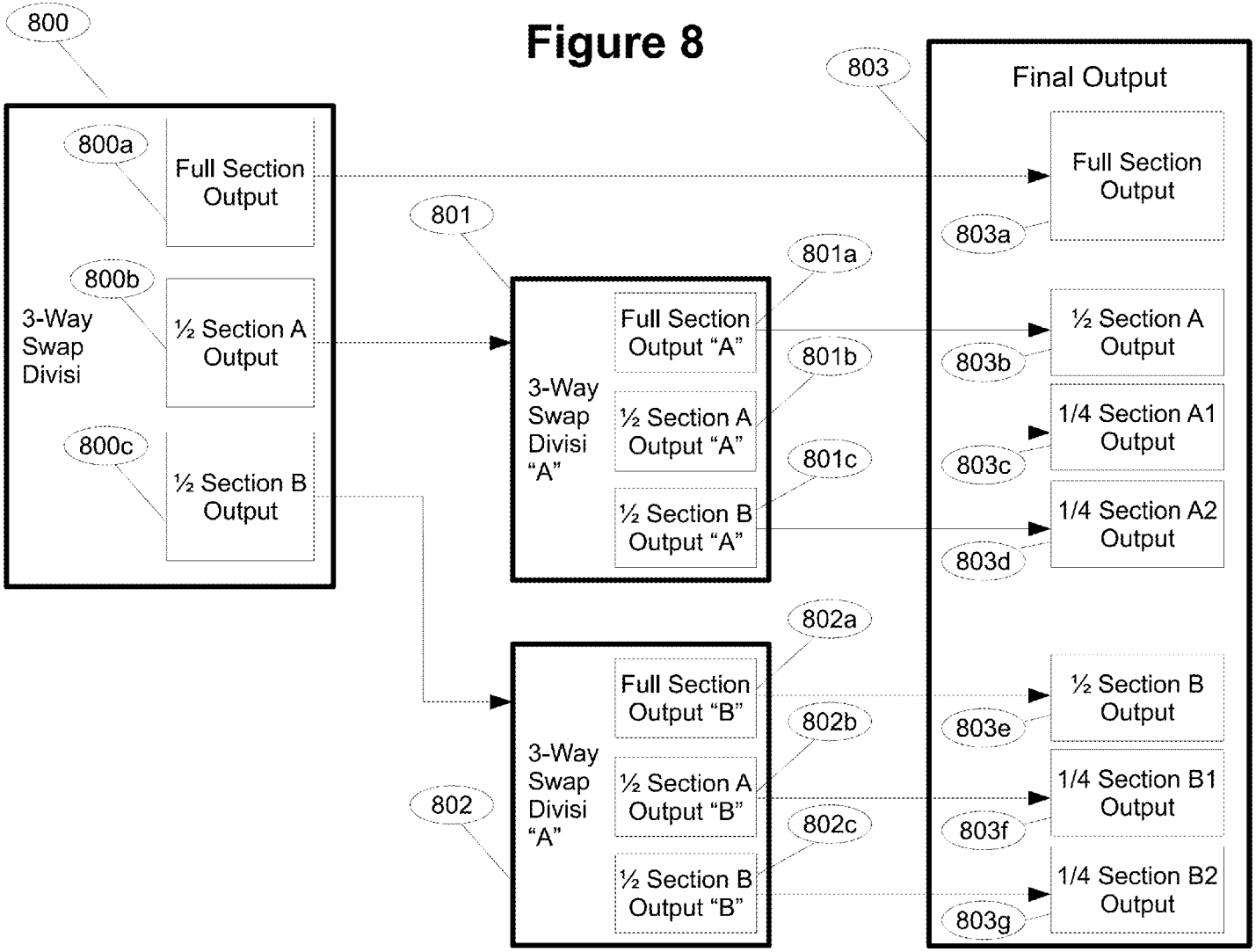
FIG. 8 is a high level flow diagram showing the use of three instances of 3-way Swap Divisi with seven discrete audio sample groups.

As can be seen in FIG. 7, and FIG. 8, implementation of 5-way or 7-way Swap Divisi is achieved by combining elements of the 2-way and 3-way swap Divisi process. The 2-way, 3-way, 5-way, and 7-way Swap Divisi examples presented in this document are not all inclusive, and the author envisions similar Swap-Divisi methods which are more complex and which go beyond the 7-way division shown herein. Generally speaking, though, there is a point of diminishing returns beyond which greater swap divisions increase the resource demands without providing much practical benefit.

The Swap Divisi process relies on a CPU to calculate and store data that is used for determining how to handle not only allocating a specific note to a group of samples, but also for compensating the sound power (i.e., the "volume") of all active groups of samples to maintain a constant balance of sound power. This part of the Swap Divisi process is akin to what happens with a live orchestra or other group in which a fixed number of musicians simply "divide" so that fewer musicians each play individual notes as more different notes are added, or they join together to play the same notes. Since the same number of musicians (and instruments) remain "in play," such real-world divisi tends to keep the sound power constant. Swap Divisi adjusts the volume as swap groups join or split their playing of various notes in a chord to prevent the volume from dipping or surging as notes are subtracted from or added to a held chord.

The Swap Divisi process begins by receiving a MIDI note event from a MIDI keyboard or other device capable of generating digital musical note events. Note events in this context can be classified as either "note-on" events, which are new notes that are added to the total number of notes currently being played; or as "note-off" events, which are existing notes that are removed from the total number of notes that are currently being played. Based on which one of these two categories a note event falls in to, a different set of parameters is used in the note allocation processor to determine what the proper set of instructions for processing the note event should be.

FIGS. 3*a* and 3*b* include exemplary values that could be set for an implementation of the swap divisi process' user adjustable variables. There are 3 general categories of user adjustable variables: the musical range 300 of the groups of audio samples or sounds being used with the embodiment, the number of swap groups used 301 and Volume Settings 302—both those settings to be applied when adding or releasing notes under specific conditions, and the appropriate volume settings for various scenarios when using these swap groups. The actual values of these variables will be based on properties of the recorded instrument or sounds being played. Therefore all values for user adjustable variables provided in this document are provided purely as examples; they are not intended to be limiting nor are they represented as being optimum.

Figure 4:
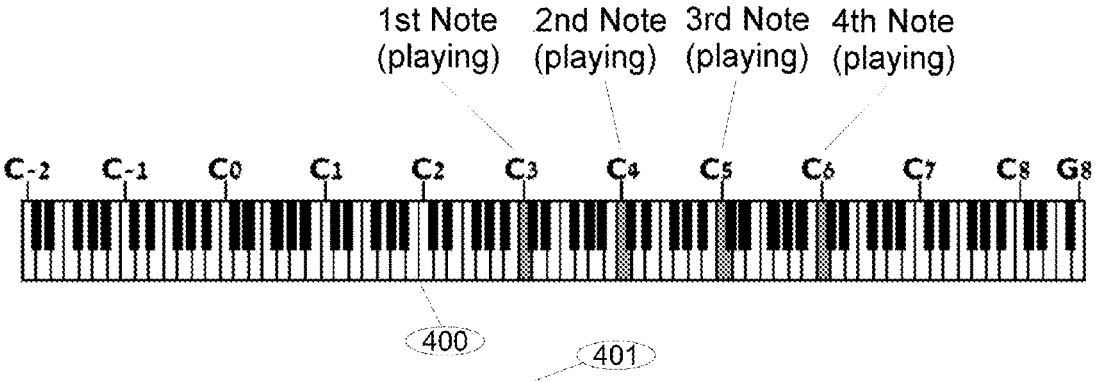

FIG. 4 illustrates an example of a keyboard 400 with 4 notes currently being held (gray keys). C3 is the first note that was played, C4 was the second, C5 was the third and C6 was the fourth note. 401 depicts the Held Note Table 107 of FIG. 1 which here is used for a 7-Way Swap Divisi process. In this example, 401 includes 7 dedicated "slots" for storing note information for each of the available recorded sample groups. The Held Note Table 401's "slots" represent recordings of various groups of instruments that are arranged as such:

402: Full Section—a sampled recording of a group of 2 or more instruments (for 5-way and 7-way methods, this must be 4 or more instruments)

403: "A" Section—a sampled recording of a group of 1 or more instruments, which in an ideal situation would equal half of the Full section 402's number of instruments. (When using 5-way and 7-way Swap Divisi methods, this would be 2 or more instruments)

404: "B" Section—a sampled recording of a group of 1 or more instruments, which in an ideal situation would equal half of the Full section 402's number of instruments. These instruments would typically be different than the instruments recorded for the 403 group. As an example, if 402 were a recording of 4 trumpets, 403 could be a recording of the first two players (Trumpets 1 and 2) and 404 could be a recording of the remaining two players (Trumpets 3 and 4). The recordings of the instruments of Section A and Section B may be tuned to have different tonal or spatial quality.

405: "A1" Section—A sampled recording of 1 or more instruments, which in an ideal situation would equal one fourth of the Full section 402's number of instruments, or one half of the "A" Section 403's number of instruments.

406: "A2" Section—A sampled recording of 1 or more instruments, which in an ideal situation would equal one fourth of the Full section 402's number of instruments, or one half of the "A" Section 403's number of instruments. These instruments would typically be different than the instruments recorded for the "A1" Section 405 group. As an example, if 403 were a recording of 16 Violins, 405 could be a recording of the first 8 players in the section (Violins 1-8) and 406 could be a recording of the remaining players (Violins 9-16).

407: "B1" Section—A sampled recording of 1 or more instruments, which in an ideal situation would equal one fourth of the Full section 402's number of instruments, or one half of the "B" Section 404's number of instruments.

Throughout this document, these "slots" will be referred to in both text and drawings by their designations of "Full Section," "A Section," "B Section," "A1 Section," "B1 Section," "A2 Section," and "B2 Section" as shown in Drawing 4. In all of the provided examples, it should be assumed that a reference to "A" or "B" section is a recording of half of the amount of instruments recorded in the "Full" Section, and that any reference to an "A1" or "A2" Section is a recording of half of the amount of instruments recorded in the "A" Section, and finally that any reference to an "B1" or "B2" Section is a recording of half of the amount of instruments recorded in the "B" Section (which is therefore a quarter of the amount in the Full Section). In an ideal scenario, these divisions of instrument numbers will be equal, however the Swap Divisi process could also be used in a situation with less conventional divisions, such as an ensemble of 5 instruments, where the A section represented a recording of the first 3 instruments, and the B section represented a recording of the remaining 2 instruments.

Detailed Description of 2-Way Swap Divisi Embodiment

Figure 5A:
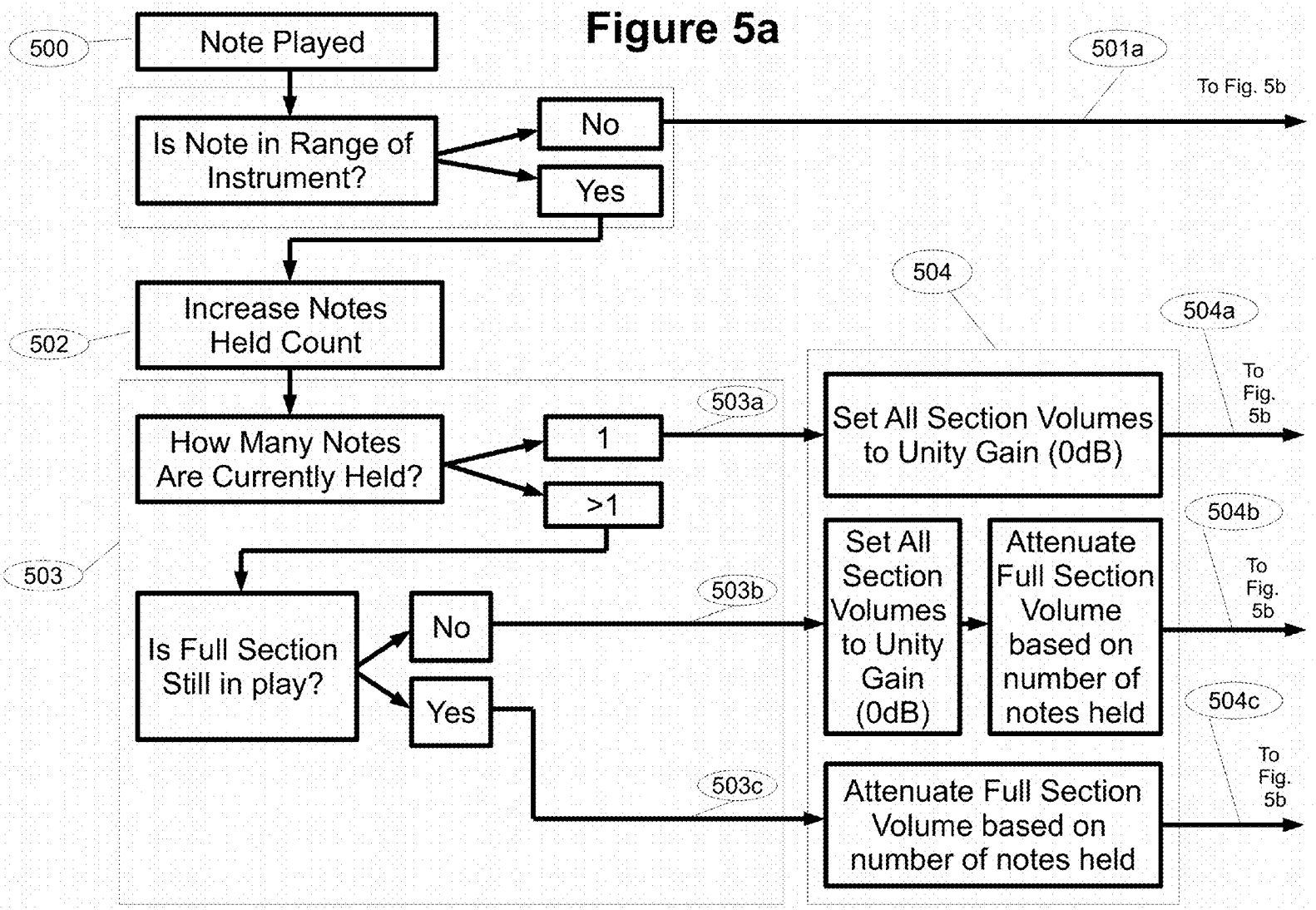
Figure 5B:
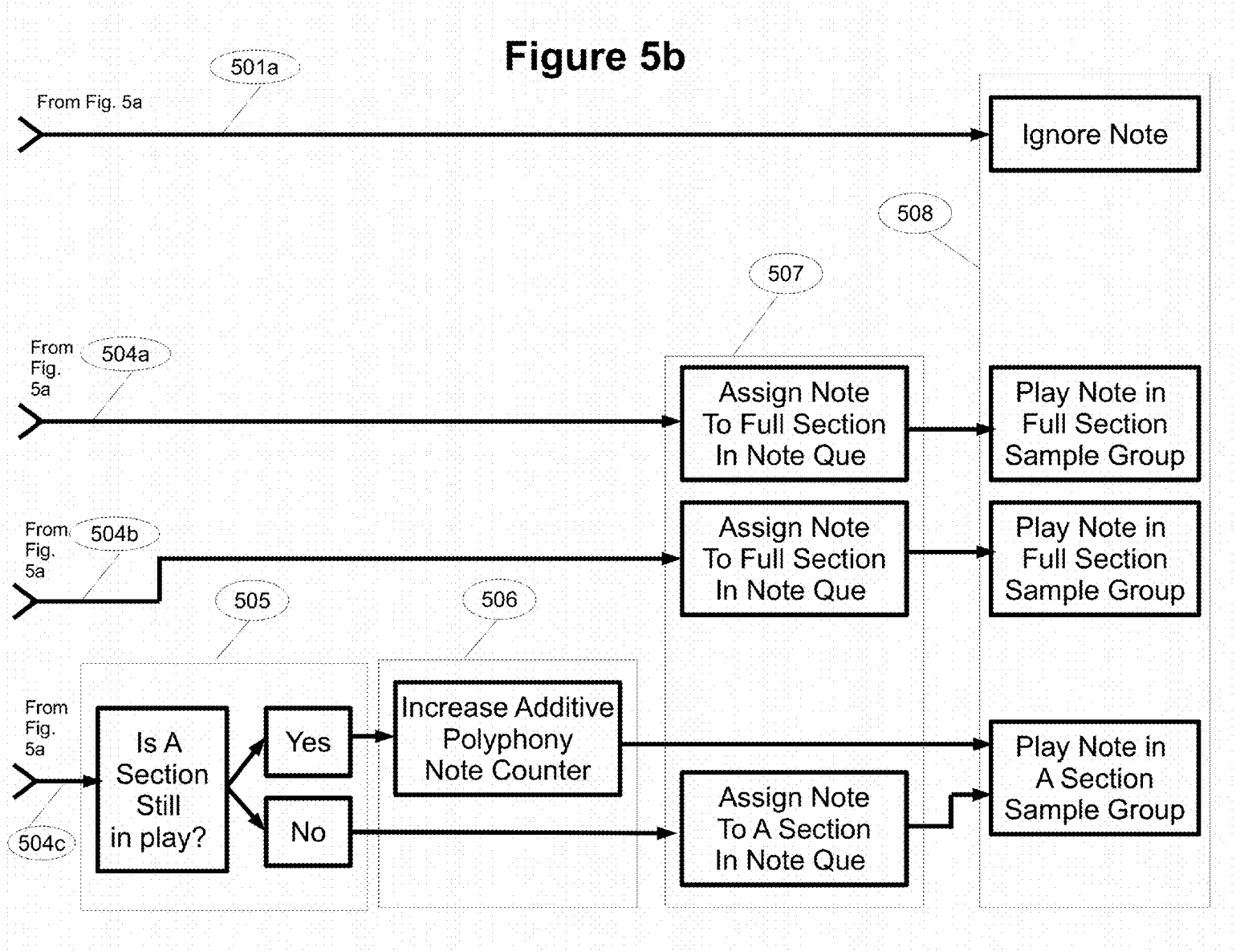
Figure 5C:
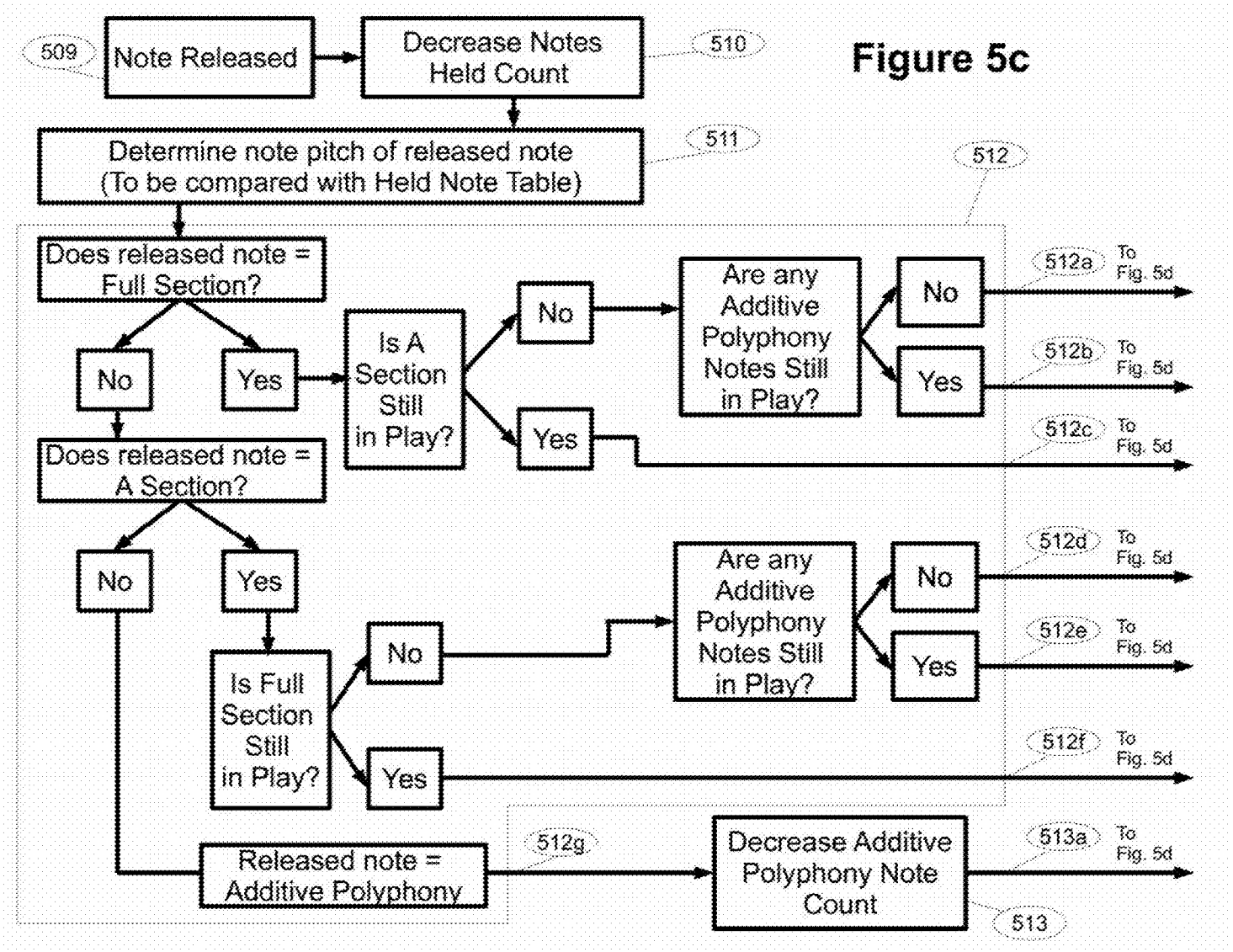
Figure 5D:
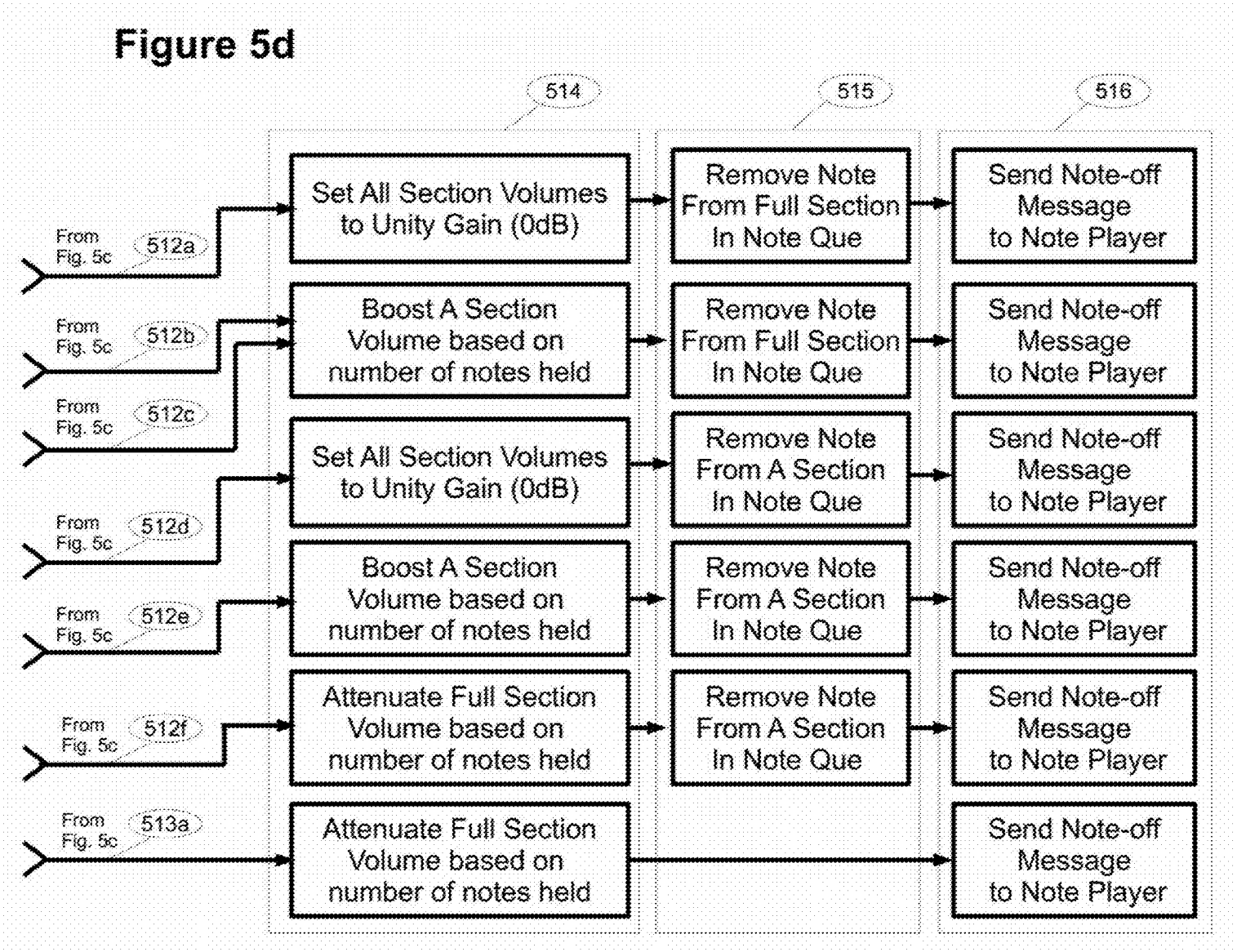

FIGS. 5*a* and 5*b* represent a detailed description of how the Note Allocation Processor 101 behaves when a note is played or added to a chord when using the 3-way Swap Divisi Process according to one embodiment. FIGS. 5*c* and 5*d* represent a detailed description of how the Note Allocation Processor 101 behaves when a note is released or subtracted from a chord when using the 3-way Swap Divisi Process according to one embodiment.

Step 500 represents the Note Allocation Processor 101 receiving an added note from the user input device 100.

Step 501 compares the note with the User Adjustable Variables 105 for the audio sample groups range. If the note is not within the specified range, the Note Allocation Processor 101 ignores the note. If the note is within the specified range, the Held Note Counter 107 is increased by one at step 502.

Step 503 represents the Added Note Handling Decision Engine 106's process for correctly determining the audio sample group to which the current note should be allocated. The Added Note Handling Decision Engine 106 must first determine if there is more than one note currently held by checking the value of the Held Note Counter 108. Since the previous step 502 has already increased the Held Note count by one, it can safely be assumed that if the current Held Note count equals 1, that there are not any other notes held, and this note is considered the first note of a chord. If the Held Note count 108 is 2 or greater (greater than 1), it can safely be assumed that a chord is being played, and that further comparisons must be made to determine the correct audio sample group that the note will be assigned to. If the Held Note Count 108 is 2 or greater, the Added Note Handling Decision Engine 106 first determines if the Full Section is still allocated to a note by checking the status of the full section "slot" in the Held Note Table 107. If the Full Section "slot" in 107 is not currently allocated to a note, the current note will be allocated to the Full Section "slot" of the Held Note Table 106. If the Full Section "slot" of 107 already has a note allocated to it, the Added Note Handling Decision Engine 106 will then need to determine if the current note is higher or lower in pitch than the Full Section. The Added Note Handling Decision Engine 106 will use the following criteria from the Held Note Table 106 and compare it with the current note to determine one of the following possible outcomes:

503*a*: If the Held Note Counter 108 has a count of exactly 1, the note will be assigned to the Full Section "slot" of the Held Note Table 107.

503*b*: If the Held Note Counter 108 has a count of 1 or more, and the Full Section "slot" of the Held Note Table 107 is not allocated, the note will be assigned to the Full Section "slot" of the Held Note Table 107.

503*c*: If the Held Note Counter 108 has a count of 1 or more, and the Full Section "slot" of the Held Note Table 107 is allocated, and if the A Section "slot" of the Held Note Table 106 is not allocated, the Added Note Handling Decision Engine 106 determines that the note should be assigned to the A Section "slot" of the Held Note Table 107.

Step 504 represents the Added Note Handling Decision Engine 106's Volume adjustments to the active audio sample groups. In the examples provided, the Full Section audio sample group's volume will be reduced based on the value of the Held Note Counter 108 and the settings for volume in the User Adjustable Variables 105. FIG. 3*b* shows an example of a possible set of volume settings. Volume settings are determined based on the total number of notes currently held, and also by which particular audio sample groups have held notes assigned to them in the Held Note Table 107. If any of the half or quarter section volumes have been boosted, their volumes are returned to unity gain (0 dB) at this step.

Step 505 represents the Added Note Handling Decision Engine 106's method of determining if the current note is within the range of the group that was determined to be the ideal group in step 503. This step makes two important determinations on how a note should be handled. This step's primary purpose is to first ensure that the note does indeed fall within the range of the audio sample group that was chosen in step 503. This data is checked against the user adjustable variables 105, specifically the data pertaining to group ranges. If the Added Note Handling Decision Engine 106 determines that the current note fits within the range of the audio sample group it is trying to allocate to, the current note will be allocated to this group. However, 106 must also determine if the Held Note Table 107 has already allocated a note in the "slot" for the audio sample group that the note will be allocated to. This will determine whether the current note is allocated to the Held Note Table 107; or (if 107 already has a note allocated in this audio sample group's "slot"), the note will be considered additive polyphony and the Additive Polyphony Counter 109 will be increased. In 2-way Swap Divisi, it is assumed that the "A Section" audio sample group will have an identical range to the Full Section Sample Group. Therefore, the only determination that the Added Note Handling Decision Engine 106 must make is whether or not to assign the note to the Held Note Table 106 or to increase the Additive Polyphony Counter. If the A section has already been allocated in the Held Note Table 107, the Additive polyphony counter 109 is increased, as shown in step 506. If the A section has not been allocated in 107, the current note is allocated to the A section "slot" of 107, as shown in step 507.

Step 506 occurs only if the Added Note Handling Decision Engine 106 assigns the current note to additive polyphony. It is necessary to maintain a separate count of additive polyphony notes for the Released Note Handling Decision Engine 110 to correctly determine its output, as will be explained in greater detail later in this document.

Step 507 depicts the assignment of the current note to a specific "slot" in the Held Note Table 106, which was determined in step 505. If the note is assigned to Additive polyphony, the Held Note Table does not store the note's data in the same "slot" that is reserved for the audio sample group that the note is assigned to.

Step 508 is the final output from the Note Allocation Processor 101 to the sample Player 102 that tells the player the correct audio sample group to play the note from.

FIG. 5*c* represents a detailed description of how the Note Allocation Processor 101 behaves when a note is released.

Step 509 represents the Note Allocation Processor 101 receiving a released note message from the user input device 100.

In step 510 the Held Note Counter 108 is decreased by 1.

Step 511 represents the Released Note Handling Decision Engine 110's process of determining the note pitch of the released note. This will be compared with the pitch of all notes stored in the Held Note Table 106 in the next step.

Step 512 represents the Released Note Handling Decision Engine 110's process for determining the correct audio sample group that the "note-off" message should be allocated to. The Released Note Handling Decision Engine 110 must first determine which audio sample groups still have notes allocated to them, by systematically checking the Held Note Table 107. The Released Note Handling Decision Engine 110 will use the following criteria from the Held Note Table 107 and compare it with the current note to determine one of the following possible outcomes:

When the Full Section is Released:

512*a*: If the released note is the same pitch as the Full Section "slot" of the Held Note Table 107, and the A Section "slot" of 107 is not allocated to a note, and the Additive polyphony counter 109 has a value of 0, it can be safely assumed that there are not any notes in play, and that the volumes of all audio sample groups should be returned to their original volume (For the purpose of this example, we are assuming that all audio sample groups start with a volume setting of unity gain (0 dB)).

512*b*: If the released note is the same pitch as the Full Section "slot" of the Held Note Table 107, and the A Section "slot" of 107 is not allocated to a note, and the Additive polyphony counter 109 has a value of 1 or greater, the volume of the A audio sample group will be adjusted as shown in step 514 to the appropriate setting indicated in the User Adjustable Variables 105 based on the current value of the Held Note Counter 108.

512*c*: If the released note is the same pitch as the Full Section "slot" of the Held Note Table 107, and the A Section "slot" of 107 is allocated to a note, the volume of the A audio sample group will be adjusted in step 514 to the appropriate setting indicated in the User Adjustable Variables 105 based on the current value of the Held Note Counter 108.

When One of the 1/2 Section (A) is Released:

512*d*: If the released note is the same pitch as the A 1/2 Section "slot" of the Held Note Table 107, and the Full Section "slot" of 107 is not allocated to a note, and the A Section "slot" of 107 is not allocated to a note, and the Additive polyphony counter 109 has a value of 0, it can be safely assumed that there are not any notes in play, and that the volumes of all audio sample groups should be returned to their original volume (For the purpose of this example, we are assuming that all audio sample groups start with a volume setting of unity gain (0 dB)).

512*e*: If the released note is the same pitch as the A 1/2 Section "slot" of the Held Note Table 107, and the Full Section "slot" of 107 is not allocated to a note, and the Additive polyphony counter 109 has a value of 1 or greater, the volume of the A audio sample group will be adjusted in step 514 to the appropriate setting indicated in the User Adjustable Variables 105 based on the current value of the Held Note Counter 108.

512*f*: If the released note is the same pitch as the A 1/2 Section "slot" of the Held Note Table 107, and the Full Section "slot" of 107 is allocated to a note, the volume of the Full Section audio sample group will be adjusted as shown in step 514 to the appropriate setting indicated in the User Adjustable Variables 105 based on the current value of the Held Note Counter 108.

When the Released Note is Determined to be Additive Polyphony:

512*g*: If the released note is not the same pitch as the Full Section or A Section "slots" of the Held Note Table 107, it can be safely assumed that the released note is considered Additive polyphony. The outcome of releasing an additive polyphony note is always the same, and results in the additive polyphony counter being decreased by one, as shown in step 513.

Step 513 only occurs if the Released Note Handling Decision Engine 110 determines the current released note to be additive polyphony. As demonstrated in step 512, the Released Note Handling Decision Engine 110 verifies that a note was originally assigned to additive polyphony through the process of elimination. However, additive polyphony must also be counted separately from the total held note count so that 110 can determine the handling of note removal.

Step 514 represents the Released Note Handling Decision Engine 110's volume adjustments to the active audio sample groups. In the examples provided, the audio sample group volume of the specified section(s) will be increased based on the value of the Held Note Counter 107 and the settings for volume in the User Adjustable Variables 105. FIG. 3*b* shows an example of a possible set of volume settings. Volume settings are determined based on the total number of notes currently held, and also by which particular audio sample groups have held notes assigned to them in the Held Note Table 107.

Step 515 represents the removal of the current released note from a specific "slot" in the Held Note Table 107, which was determined in step 512.

Step 516 represents the final output from the Note Allocation Processor 101 to the sample Player 102 that sends 102 a note off message for the currently released note.

Detailed Description of 3-Way Swap Divisi Embodiment

Figure 6D:
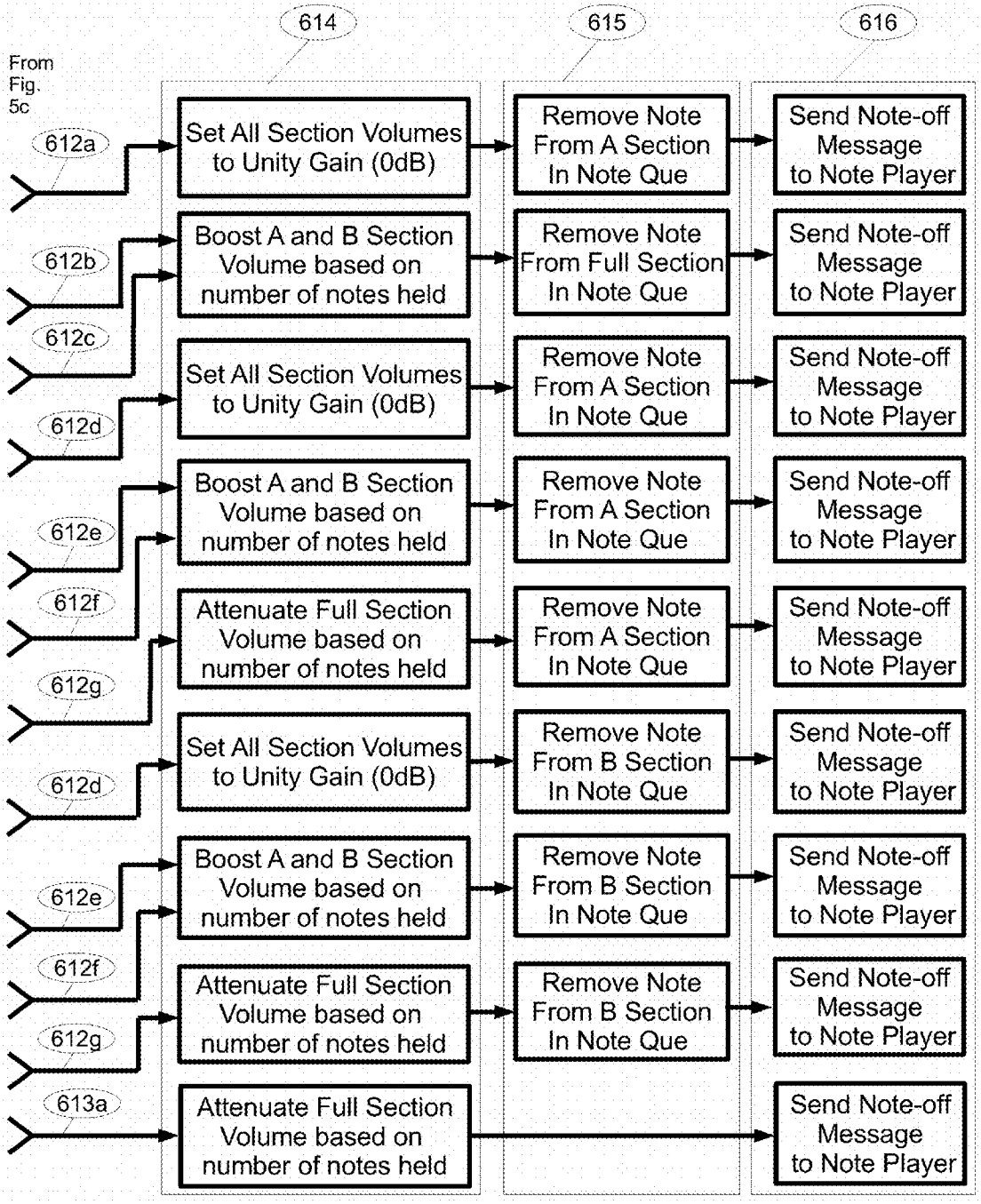

FIGS. 6*a* and 6*b* represent a detailed description of how the Note Allocation Processor 101 behaves when a note is played or added to a chord when using the 3-way Swap Divisi Process, according to one embodiment. FIGS. 6*c* and 6*d* represent a detailed description of how the Note Allocation Processor 101 behaves when a note is released or subtracted from a chord when using the 3-way Swap Divisi Process, according to one embodiment.

Step 600 represents the Note Allocation Processor 101 receiving an added note from the user input device 100.

Step 601 compares the note with the User Adjustable Variables 105 for the audio sample groups note range. If the note is not within the specified range, the Note Allocation Processor 101 ignores the note. If the note is within the specified range, the Held Note Counter 108 is increased by one at step 602.

Step 603 represents the Added Note Handling Decision Engine 106's process for determining the correct audio sample group that the current note should be allocated to. The Added Note Handling Decision Engine 106 must first determine if there is more than one note currently held by checking the value of the Held Note Counter 108. Since the previous step 602 has already increased the Held Note count by one, it can safely be assumed that if the current Held Note count equals 1, that there are not any other notes held, and this note is considered the first note of a chord. If the Held Note count 108 is 2 or greater (i.e., greater than 1), it can safely be assumed that a chord is being played, and that further comparisons must be made to determine the correct audio sample group that the note will be assigned to. If the Held Note Count 108 is 2 or greater, the Added Note Handling Decision Engine 106 first determines if the Full Section is still allocated to a note by checking the status of the full section "slot" in the Held Note Table 107. If the Full Section "slot" in 107 is not currently allocated to a note, the current note will be allocated to the Full Section "slot" of the Held Note Table 107. If the Full Section "slot" of 107 already has a note allocated to it, the Added Note Handling Decision Engine 106 will then need to determine if the current note is higher or lower in pitch than the Full Section. The Added Note Handling Decision Engine 106 will use the following criteria from the Held Note Table 107 and compare it with the current note to determine one of the following possible outcomes:

603*a*: If the Held Note Counter 108 has a count of exactly 1, the note will be assigned to the Full Section "slot" of the Held Note Table 107.

603*b*: If the Held Note Counter 108 has a count of 1 or more, and the Full Section "slot" of the Held Note Table 107 is not allocated, the note will be assigned to the Full Section "slot" of the Held Note Table 107.

603*c*: If the current note is not higher in pitch than the Full Section and the B Section "slot" of the Held Note Table 107 is not allocated, the Added Note Handling Decision Engine 106 determines that the note should be assigned to the B Section "slot" of the Held Note Table 107.

603*d*: If the current note is higher in pitch than the Full Section and the A Section "slot" of the Held Note Table 107 is not allocated, the Added Note Handling Decision Engine 106 determines that the note should be assigned to the A Section "slot" of the Held Note Table 107.

Step 604 represents the Added Note Handling Decision Engine 106's Volume adjustments to the active audio sample groups. In the examples provided, the Full Section audio sample group's volume will be reduced based on the value of the Held Note Counter 108 and the settings for volume in the User Adjustable Variables 105. FIG. 3*b* shows an example of a possible set of volume settings. Volume settings are determined based on the total number of notes currently held, and also by which particular audio sample groups have held notes assigned to them in the Held Note Table 107. If any of the half or quarter section volumes have been boosted, their volumes are returned to unity gain (0 dB) at this step.

Steps 605*a* and 605*b* represent the Added Note Handling Decision Engine 106's method of determining if the current note is within the range of the group that was determined to be the ideal group in step 603. This step makes two important determinations on how a note should be handled. This step's primary purpose is to first ensure that the note does indeed fall within the range of the audio sample group that was chosen in step 603. This data is checked against the user adjustable variables 105, specifically the data pertaining to group ranges. If the Added Note Handling Decision Engine 106 determines that the current note fits within the range of the audio sample group it is trying to allocate to, the current note will be allocated to this group. However, 106 must also determine if the Held Note Table 107 has already allocated a note in the "slot" for the audio sample group that the note will be allocated to. This will determine whether the current note is allocated to the Held Note Table 107; or (if 107 already has a note allocated in this audio sample group's "slot"), the note will be considered additive polyphony and the Additive Polyphony Counter 109 will be increased. The following substeps describe the various possibilities for this process:

605*a*: (Favor A Section Assignment) In 3-way, 5-way or 7-way Swap modes, it is possible for the A and B section audio sample groups to have different ranges, so the Added Note Handling Decision Engine 106 must first determine that the note which was intended to be allocated to the A section audio sample group in step 603 is within the range of the A section as stated in the User Adjustable Variables 105. There are 4 possible outcomes from this step:

1. If the note is within the range of the A section, and the A section has already been allocated in the Held Note Table 106, the Additive polyphony counter is increased, as shown in step 606.
2. If the note is within the range of the A section, and the A section has not been allocated in 106, the current note is allocated to the B section "slot" of 106, as shown in step 607.
3. If the note is not within the range of the A section, and the B section has already been allocated in the Held Note Table 106, the Additive polyphony counter is increased, as shown in step 606.
4. If the note is not within the range of the A section, and the B section has not been allocated in 106, the current note is allocated to the A section "slot" of 106, as shown in step 607.

605*b*: (Favor B Section Assignment) In 3-way, 5-way or 7-way Swap modes, it is possible for the A and B section audio sample groups to have different ranges, so the Added Note Handling Decision Engine 109 must first determine that the note which was intended to be allocated to the B section audio sample group in step 603 is within the range of the B section as stated in the User Adjustable Variables 105. There are 4 possible outcomes from this step:

1. If the note is within the range of the B section, and the B section has already been allocated in the Held Note Table 107, the Additive polyphony counter is increased, as shown in step 606.
2. If the note is within the range of the B section, and the B section has not been allocated in 107, the current note is allocated to the B section "slot" of 107, as shown in step 607.
3. If the note is not within the range of the B section, and the A section has already been allocated in the Held Note Table 107, the Additive polyphony counter is increased, as shown in step 606.
4. If the note is not within the range of the B section, and the A section has not been allocated in 107, the current note is allocated to the A section "slot" of 106, as shown in step 607.

Step 606 occurs only if the Added Note Handling Decision Engine 106 assigns the current note to additive polyphony. It is necessary to maintain a separate count of additive polyphony notes for the Released Note Handling Decision Engine 110 to correctly determine its output, as will be explained in greater detail later in this document.

Step 607 depicts the assignment of the current note to a specific "slot" in the Held Note Table 107, which was determined in step 605. If the note is assigned to Additive polyphony, the Held Note Table does not store the note's data in the same "slot" that is reserved for the audio sample group that the note is assigned to.

Step 608 is the final output from the Note Allocation Processor 101 to the sample Player 102 that tells the player the correct audio sample group from which to play the note.

FIG. 6*c* represents a detailed description of how the Note Allocation Processor behaves when a note is released, according to one embodiment.

Step 609 represents the Note Allocation Processor 101 receiving a released note message from the user input device 100.

In step 610 the Held Note Counter 108 is decreased by 1.

Step 611 represents the Released Note Handling Decision Engine 110's process of determining the note pitch of the released note. This will be compared with the pitch of all notes stored in the Held Note Table 107 in the next step.

Step 612 represents the Released Note Handling Decision Engine 110's process for determining the correct audio sample group that the "note-off" message should be allocated to, according to one embodiment. The Released Note Handling Decision Engine 110 must first determine which audio sample groups still have notes allocated to them, by systematically checking the Held Note Table 107. The Released Note Handling Decision Engine 110 will use the following criteria from the Held Note Table 107 and compare it with the current note to determine one of the following possible outcomes:

When the Full Section is Released:

612*a*: If the released note is the same pitch as the Full Section "slot" of the Held Note Table 107, and either or both of the 1/2 Section (A or B) "slots" of 107 are not allocated to a note, and the Additive polyphony counter 109 has a value of 0, it can be safely assumed that there are not any notes in play, and that the volumes of all audio sample groups should be returned to their original volume (For the purpose of this example, we are assuming that all audio sample groups start with a volume setting of unity gain (0 dB)).

612*b*: If the released note is the same pitch as the Full Section "slot" of the Held Note Table 107, and either or both of the 1/2 Section (A or B) "slots" of 107 are not allocated to a note, and the Additive polyphony counter 109 has a value of 1 or greater, the volume of the A and/or B audio sample groups will be adjusted as shown in step 614 to the appropriate setting indicated in the User Adjustable Variables 105 based on the current value of the Held Note Counter 108.

612*c*: If the released note is the same pitch as the Full Section "slot" of the Held Note Table 106, and either or both of the 1/2 Section (A or B) "slots" of 106 are allocated to a note, the volume of the A and/or B audio sample groups will be adjusted in step 614 to the appropriate setting indicated in the User Adjustable Variables 105 based on the current value of the Held Note Counter 107.

When One of the 1/2 Sections (a or B) is Released:

612*d*: If the released note is the same pitch as either the A or B 1/2 Section "slot" of the Held Note Table 107, and the Full Section "slot" of 107 is not allocated to a note, and the opposite 1/2 Section (A or B) "slot" of 107 is not allocated to a note, and the Additive polyphony counter 109 has a value of 0, it can be safely assumed that there are not any notes in play, and that the volumes of all audio sample groups should be returned to their original volume (For the purpose of this example, we are assuming that all audio sample groups start with a volume setting of unity gain (0 dB)).

612*e*: If the released note is the same pitch as either the A or B 1/2 Section "slot" of the Held Note Table 107, and the Full Section "slot" of 107 is not allocated to a note, and the opposite 1/2 Section (A or B) "slot" of 107 is not allocated to a note, and the Additive polyphony counter 109 has a value of 1 or greater, the volume of the A and/or B audio sample groups will be adjusted as shown in step 614 to the appropriate setting indicated in the User Adjustable Variables 105 based on the current value of the Held Note Counter 108.

612*f*: If the released note is the same pitch as either the A or B 1/2 Section "slot" of the Held Note Table 107, and the Full Section "slot" of 107 is not allocated to a note, and the opposite 1/2 Section (A or B) "slot" of 107 is allocated to a note, the volume of the A and/or B audio sample groups will be adjusted in step 614 to the appropriate setting indicated in the User Adjustable Variables 105 based on the current value of the Held Note Counter 108.

612*g*: If the released note is the same pitch as either the A or B 1/2 Section "slot" of the Held Note Table 107, and the Full Section "slot" of 107 is allocated to a note, the volume of the Full Section audio sample group will be adjusted as shown in step 614 to the appropriate setting indicated in the User Adjustable Variables 105 based on the current value of the Held Note Counter 108.

When the Released Note is Determined to be Additive Polyphony:

612*h*: If the released note is not the same pitch as the Full Section, A, or B Section "slots" of the Held Note Table 107, it can be safely assumed that the released note is considered additive polyphony. The outcome of releasing an additive polyphony note is always the same, and results in the additive polyphony counter 109 being decreased by one, as shown in step 613.

Step 613 only occurs if the Released Note Handling Decision Engine 110 determines the current released note to be additive polyphony. As demonstrated in step 612, the Released Note Handling Decision Engine 110 verifies that a note was originally assigned to additive polyphony through the process of elimination. However, additive polyphony must also be counted separately from the total held note count so that 110 can determine the handling of note removal.

Step 614 represents the Released Note Handling Decision Engine 110's volume adjustments to the active audio sample groups. In the examples provided, the audio sample group volume of the specified section(s) will be increased based on the value of the Held Note Counter 108 and the settings for volume in the User Adjustable Variables 105. FIG. 3*b* shows an example of a possible set of volume settings. Volume settings are determined based on the total number of notes currently held, and also by which particular audio sample groups have held notes assigned to them in the Held Note Table 107.

Step 615 represents the removal of the current released note from a specific "slot" in the Held Note Table 107, which was determined in step 612.

Step 616 represents the final output from the Note Allocation Processor 101 to the sample Player 102 that sends 102 a note off message for the currently released note.

Overview of Extended Swap Divisi

The Swap Divisi process can be implemented with a virtually infinite number of sample group divisions. This method is referred to as Extended Swap Divisi and relies on routing the outputs of an initial instance of 2-way (FIG. 5*a*, 5*b*, 5*c*, 5*d*) or 3-way (FIGS. 6*a*, 6*b*, 6*c*, 6*d*) Swap Divisi through additional instances of Swap Divisi to further divide the output among a larger set of sample groups. These 2-way and 3-way Swap Divisi processes are used as the basic building blocks of more complicated algorithms that involve more sample groups. The following descriptions to FIG. 7 and FIG. 8 explain how the two simpler forms of Swap Divisi can be combined to create 5-way and 7-way Swap Divisi. It should be apparent from these examples that Swap Divisi can be extended far beyond these examples for use with virtually any number of sample groups that a specific application may require.

Description of the 5-Way Swap Divisi Process Using Extended Swap Divisi

An example of implementing Extended Swap Divisi is illustrated in FIG. 7, in this example implementing a 5-way Swap Divisi. The process of this embodiment uses an extended Swap Divisi combination of one initial instance of 3-way Swap Divisi 700, which outputs it's A and B groups to two discrete instances of 2-way Swap Divisi 701 and 702. That is, this embodiment implements a first decision block, which, in this case is a three-way decision block, and the output of the first decision block is routed to one of two secondary decision blocks, in this example each is a two-way decision block.

Step 700 represents the initial instance of Swap Divisi, i.e., the first 3-way decision block. As with 3-way Swap Divisi, there are outputs to a Full Section 700*a*, an "A" Half section 700*b*, and a "B" Half section 700*c*.

Step 701 represents the first secondary decision block, which is the "A" instance of a 2-way Swap Divisi. This instance receives its input from the "A" 1/2 section output 700*b* of the 3-way Swap Divisi process from step 700. This instance has two outputs, 701*a*, which is the full Section A (corresponding to half of the Full Section), and 701*b*, which is the half of Section A (corresponding to a quarter of the Full Section).

Step 702 represents the second secondary decision block, which is the "B" instance of a 2-way Swap Divisi. This instance receives its input from the "B" 1/2 section output 700*c* of the 3-way Swap Divisi process from step 700. This instance has two outputs, 702*a*, which is the full Section B (corresponding to half of the Full Section), and 702*b*, which is the half of Section B (corresponding to a quarter of the Full Section).

Step 703 represents the final output of the Extended Swap Divisi Process as it connects to the five sample groups used in this configuration: Full Section output 703*a*, 1/2 Section A output 703*b*, 1/4 Section A1 Output 703*c*, 1/2 section B Output 703*d*, and 1/4 Section B1 output 703*e*. As shown, the final output to the Full section sample group 703*a* is received directly from the first decision block, i.e., the initial 3-way Swap Divisi instance 700 via its full section output 700*a*. The final output to the 1/2 Section A sample group 703*b* is received from the 2-way Swap Divisi instance A 701 via its full section output 701*a*. The final output to the 1/4 Section A1 sample group 703*c* is received from the 2-way Swap Divisi instance A 701 via its 1/2 section A output 701*b*. The final output to the 1/2 Section B sample group 703*d* is received from the 2-way Swap Divisi instance B 702 via its full section output 702*a*. The final output to the 1/4 Section B1 sample group 703*e* is received from the 2-way Swap Divisi instance B 702 via its 1/2 section A output 702*b*.

Description of the 7-Way Swap Divisi Process Using Extended Swap Divisi

Another example of implementing Extended Swap Divisi is illustrated in FIG. 8, in this example implementing a 7-way Swap Divisi. The 7-way Swap Divisi process of this embodiment uses an Extended Swap Divisi combination of one initial instance of 3-way Swap Divisi, which outputs it's A and B groups to two discrete instances of 3-way Swap Divisi. That is, this embodiment implements an initial decision block, which, in this case is a three-way decision block, and the output of the initial decision block is routed to one of two subsequent decision blocks, in this example each is a three-way decision block. It can be appreciated that the output of each secondary decision block can be routed to a tertiary decision block, e.g., a tertiary two-way decision block.

Step 800 represents the initial instance of Swap Divisi. As with 3-way Swap Divisi, there are outputs to a Full Section 800*a*, an "A" Half section 800*b*, and a "B" Half section 800*c*.

Step 801 represents the "A" instance of 3-way Swap Divisi. This instance receives its input from the "A" 1/2 section output 800*b* of the 3-way Swap Divisi process from step 800. This instance has three outputs, 801*a*, 801*b* and 801*c*.

Step 802 represents the "B" instance of 2-way Swap Divisi. This instance receives its input from the "B" 1/2 section output 800*c* of the 3-way Swap Divisi process from step 800. This instance has three outputs, 802*a*, 802*b* and 802*c*.

Step 803 represents the final output of the Extended Swap Divisi Process as it connects to the seven sample groups used in this configuration: Full Section output 803*a*, 1/2 Section A output 803*b*, 1/4 Section A1 Output 803*c*, 1/4 Section A2 Output 803*d*, 1/2 section B Output 803*e*, 1/4 Section B1 output 803*f*, and 1/4 Section B2 output 803*g*. As shown, the final output to the Full section sample group 803*a* is received directly from the initial 3-way Swap Divisi instance 800 via its full section output 800*a*. The final output to the 1/2 Section A sample group 803*b* is received from the 2-way Swap Divisi instance A 801 via its full section output 801*a*. The final output to the 1/4 Section A1 sample group 803*c* is received from the 3-way Swap Divisi instance A 801 via its 1/2 section A output 801*b*. The final output to the 1/4 Section A2 sample group 803*d* is received from the 3-way Swap Divisi instance A 801 via its 1/2 section B output 801*c*. The final output to the 1/2 Section B sample group 803*e* is received from the 3-way Swap Divisi instance B 802 via its full section output 802*a*. The final output to the 1/4 Section B1 sample group 803*f* is received from the 3-way Swap Divisi instance B 802 via its 1/2 section A output 802*b*. The final output to the 1/4 Section B2 sample group 803*g* is received from the 3-way Swap Divisi instance B 802 via its 1/2 section B output 802*c*.

The various embodiments described above may be implemented in a standard music workstation, or in a computer-based digital audio workstation (DAW). When implemented in a DAW, the embodiments may be implemented in software that may be installed in any general purpose computer, thus converting the computer to a DAW. Such a computer should include a sound card (also called a sound converter or audio interface), and at least one input device for adding or modifying musical note data. This could be as simple as a mouse, and as sophisticated as a MIDI controller keyboard or an automated fader board for mixing track volumes. The computer acts as a host for the sound card and the Swap Divisi software and provides processing power for audio editing. The sound card (if used) or external audio interface typically converts analog audio signals into digital form, e.g., for processing, and converts digital to analog audio for playback. The Swap Divisi software may control all related hardware components and provide a user with an interface to allow for recording, editing, and playback.

The invention claimed is:

1. A computerized method for sounding notes triggered by an input device coupled to a processor, comprising:

receiving at the processor a first "note on" input from the input device;

assigning by the processor the first note to be sounded by a group of designated instruments;

receiving at the processor a subsequent "note on" input from the input device;

assigning by the processor the subsequent note to be sounded by a sub-group comprising a smaller number of the designated instruments.

2. The method of claim 1, further comprising, upon assigning the subsequent note, reducing sounding volume of the first note.

3. The method of claim 2, wherein the sub-group is chosen from a plurality of available sub-groups, each of the plurality of available sub-groups comprising a smaller number of the designated instruments.

4. The method of claim 3, wherein at least one of the plurality of available sub-groups comprises half number of the designated instruments, and at least one of the plurality of available sub-groups comprises a quarter the number of the designated instruments.

5. The method of claim 3, further comprising:

receiving at the processor a "note off" input from the input device;

determining whether pitch of the note off input corresponds to the first "note on" or the subsequent note on;

when the pitch corresponds to the first note on, ceasing sounding by the group of designated instruments and boosting volume of any sounding sub-group; and, when the pitch corresponds to the subsequent note on, ceasing sounding by the sub-group sounding the subsequent note.

6. The method of claim 5, further comprising:

when the pitch corresponds to the subsequent note on boosting volume of the first note.

7. The method of claim 5, further comprising:

upon ceasing sounding by the group of designated instruments, activating a "note release" sound corresponding to the group of designated instrument; and upon ceasing sounding by the sub-group, activating a "note release" sound corresponding to the sub-group.

8. The method of claim 7, wherein the "note release" is a sample of ambient sound of a note released by corresponding musical instrument.

9. The method of claim 1, wherein the group of designated instruments comprises a sampling of an orchestral section and the sub-group comprises a sampling of a fraction of an orchestral section.

10. A program stored on a computer-readable storage medium and configured for, when executed on a processor, cause the processor to perform note allocations to a section or to a sub-section, by executing the functions comprising:

receiving a "note on" input at the processor;

interrogating by the processor a first decision block to determine whether the section is already assigned a note and, when the section is not already assigned a note, assigning by the processor the "note on" input to the section;

when the section is already assigned a note, assigning by the processor the "note on" to the sub-section;

wherein the section comprises a sounding of x number of musical instruments and the sub-section comprises a sounding of no more than x-1 musical instruments; and, sounding the "note on" by a note player according to the assignment to the section or sub-section.

11. The program of claim 10, further comprising, upon assigning the "note on" to the sub-section, decreasing sounding volume of the section.

12. The program of claim 10, further comprising, upon assigning the "note on" to the sub-section, interrogating a second decision block to determine whether the sub-section is already assigned a note and, when the sub-section is not already assigned a note, assigning the "note on" input to the sub-section;

when the sub-section is already assigned a note, assigning the note to a partial-section, wherein the partial-section comprises a sounding of no more than x-2 musical instruments.

13. The program of claim 12, further comprising, upon assigning the "note on" to the partial-section, decreasing sounding volume of at least one of the section and the sub-section.

14. The program of claim 12, wherein the sub-section comprises x/2 musical instruments and the partial section comprises x/4 musical instruments.

15. The program of claim 10, further comprising maintaining a table of all notes currently being assigned.

16. The program of claim 10, further comprising maintaining a counter of number of notes currently being assigned.

17. The program of claim 10, further comprising maintaining an additive polyphony counter indicating concurrent sounding of multiple notes.

18. The program of claim 10, further comprising prior to interrogating the first decision block, determining whether pitch of the "note on" is within pitch range of musical instrument of the section and, when the pitch of the "note on" is outside of the pitch range, ignoring the "note on" input.

19. The program of claim 10, further comprising:

receiving a "note release" input;

interrogating a first decision block to determine whether the "note release" corresponds to "note on" assigned to the section;

when the "note release" corresponds to "note on" assigned to the section, removing the assigned "note on" from the section and assigning a "note off" to the section;

when the "note release" does not correspond to "note on" assigned to the section, removing the assigned "note on" from the sub-section and assigning a "note off" to the sub-section;

wherein the "note off" comprises an ambient sounding of a musical instrument ceasing to play a note.

20. The program of claim 10, wherein the section comprises a first group of instruments having a first pitch range and a second group of instruments having a second pitch range lower than the first pitch range, and wherein the sub-section comprises the first group of instruments and further comprising a second sub-section comprising the second group of instruments; and, wherein when the section is already assigned a note, assigning the "note on" to the sub-section or to the second sub-section according to the pitch of the note on.

* * * * *